US011712891B2

(12) United States Patent
Hamada et al.

(10) Patent No.: US 11,712,891 B2
(45) Date of Patent: Aug. 1, 2023

(54) LIQUID EJECTION HEAD AND LIQUID EJECTION APPARATUS

(71) Applicant: CANON KABUSHIKI KAISHA, Tokyo (JP)

(72) Inventors: Yoshihiro Hamada, Kanagawa (JP); Keiji Tomizawa, Kanagawa (JP); Yoshiyuki Nakagawa, Kanagawa (JP); Akiko Hammura, Tokyo (JP); Shuzo Iwanaga, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 57 days.

(21) Appl. No.: 17/347,912

(22) Filed: Jun. 15, 2021

(65) Prior Publication Data

US 2021/0402770 A1 Dec. 30, 2021

(30) Foreign Application Priority Data

Jun. 26, 2020 (JP) ..... 2020-110699

(51) Int. Cl.
*B41J 2/14* (2006.01)

(52) U.S. Cl.
CPC ..... *B41J 2/14145* (2013.01); *B41J 2/1404* (2013.01); *B41J 2/1433* (2013.01); *B41J 2202/12* (2013.01); *B41J 2202/20* (2013.01)

(58) Field of Classification Search
CPC .... B41J 2/14145; B41J 2/1404; B41J 2/1433; B41J 2/104; B41J 2202/12; B41J 2202/20
See application file for complete search history.

(56) References Cited

U.S. PATENT DOCUMENTS 10,179,453 B2 1/2019 Okushima et al.
2017/0197439 A1* 7/2017 Okushima ..... B41J 2/14024

FOREIGN PATENT DOCUMENTS

JP 2017-124619 A 7/2017

* cited by examiner

*Primary Examiner* — Jason S Uhlenhake
(74) *Attorney, Agent, or Firm* — Venable LLP

(57) ABSTRACT

A liquid ejection head that can suppress variation in the circulation flow rate or the pressure of the liquid among a plurality of pressure chambers and suppress a difference in temperature distribution between adjacent element substrates to suppress image unevenness includes a plurality of ejection modules including an element substrate in which a plurality of ejection orifices that eject a liquid are aligned in an array. In one ejection module of the ejection modules adjacent to each other, the liquid is supplied from one side of an ejection orifice array, and the liquid is collected from the other side of the ejection orifice array, and in the other ejection module of the ejection modules adjacent to each other, the liquid is supplied from the other side, and the liquid is collected from the one side.

14 Claims, 13 Drawing Sheets

LIQUID EJECTION HEAD AND LIQUID EJECTION APPARATUS

BACKGROUND OF THE INVENTION

Field of the Invention

The present invention relates to a liquid ejection head and a liquid ejection apparatus.

Description of the Related Art

In the field of ink jet recording to eject a liquid such as ink and perform recording, a method of increasing the resolution in recording by densely arranging a plurality of ejection orifices in order to achieve higher definition of recording is known. Further, to realize higher quality recording, a method of forcing a liquid in pressure chambers communicating with ejection orifices to flow and causing a thickened liquid in the pressure chambers to flow out thereof is known. However, when the number of ejection orifices forming an ejection orifice array is increased due to the plurality of densely arranged ejection orifices, since the ejection orifices are distributed in a wide range in an array direction of the ejection orifice array (the alignment direction of ejection orifices), the circulation flow rate or the pressure of the liquid is likely to vary among the plurality of pressure chambers arranged in the array direction. Further, dense arrangement of the plurality of ejection orifice arrays makes it difficult to increase the distance of a flow path extending in the array direction (the length in a direction in which the plurality of ejection orifice arrays are arranged) due to adjacent flow paths and is more affected by a pressure loss. In both the cases, the circulation flow rate or the pressure of the liquid is likely to vary among the plurality of pressure chambers arranged in the array direction. This results in a problem of an increased difference in ejection characteristics or coloring material densities among a plurality of ejection orifices.

A liquid ejection head of Japanese Patent Application Laid-Open No. 2017-124619 has, in a flow path communicating with the pressure chambers, a supply side communication port configured to supply a liquid via a supply port array and common supply paths and a collection side communication port configured to collect a liquid in the flow path via a collection port array and common collection paths. With respect to at least one of the supply side communication port and the collection side communication port, a plurality of such communication ports are provided. Such a liquid ejection head is less affected by a pressure loss and can suppress the variation in the circulation flow rate or the pressure of the liquid in the plurality of pressure chambers. In the liquid ejection head of Japanese Patent Application Laid-Open No. 2017-124619, a plurality of supply side communication ports and a plurality of collection side communication ports are provided to an element substrate, and in some configuration, the numbers thereof may be the same. In a so-called line-type liquid ejection head in which two or more such element substrates are arranged, a temperature difference may occur between adjacent element substrates, and this may cause image unevenness (density unevenness) due to the temperature difference.

The object of the present invention is to provide a liquid ejection head and a liquid ejection apparatus that can suppress variation in the circulation flow rate or the pressure of the liquid among a plurality of pressure chambers and suppress a difference in temperature distribution between adjacent element substrates to suppress image unevenness.

SUMMARY OF THE INVENTION

A liquid ejection head of the present invention includes: a plurality of ejection modules each including an element substrate in which a plurality of ejection orifices that eject a liquid are aligned in an array. In one ejection module of the ejection modules adjacent to each other, the liquid is supplied from one side of an ejection orifice array, and the liquid is collected from the other side of the ejection orifice array, and in the other ejection module of the ejection modules adjacent to each other, the liquid is supplied from the other side, and the liquid is collected from the one side.

Further features of the present invention will become apparent from the following description of exemplary embodiments with reference to the attached drawings.

DESCRIPTION OF THE EMBODIMENTS

Next, preferable embodiments of the present invention will be described with reference to the drawings. Each embodiment described below is a suitable specific example of the present invention and thus is provided with various technically preferable limitations. However, the present invention is not limited to each embodiment described below or other specific configurations as long as the concept of the present invention is followed. A liquid ejection head based on the present invention is characterized in that it suppresses occurrence of a difference in level in the temperature distribution between adjacent recording element substrates. As an example, the following description will be provided with an example of a so-called thermal system liquid ejection head that uses a heat generating element as a recording element, which generates energy used for ejecting a liquid, and uses heat to generate a bubble in a liquid in pressure chambers and eject the liquid from ejection orifices. However, liquid ejection heads to which the present invention is applicable are not limited to those using the thermal system, and the present invention can also be applied to liquid ejection heads that employ a piezo system using a piezoelectric element or other various liquid ejection systems. Since energy is provided to a liquid to eject the liquid even with a liquid ejection head other than those using the thermal system, heat may be generated on recording element substrates, and a difference in level in the temperature distribution may occur between adjacent recording element substrates. The liquid ejection head and a liquid ejection apparatus according to the embodiment of the present invention will be described below with reference to the drawings. The liquid ejection head and the liquid ejection apparatus of the present invention are applicable to an apparatus such as a printer, a copying machine, a facsimile machine having a communication system, a word processor having a printer unit, or the like and even an industrial recording apparatus multiply combined with various processing apparatuses. The liquid ejection head and the liquid ejection apparatus of the present invention can also be used in bio-chip fabrication, electronic circuit printing, or the like, for example. Each embodiment described below is a suitable specific example of the present invention and has various technically suitable required components. However, the present invention is not limited to the embodiments described below or other specific examples, and various changes are possible within a scope not departing from the technical concept.

(Description of Basic Configuration of Ink Jet Recording Apparatus)

Figure 1:
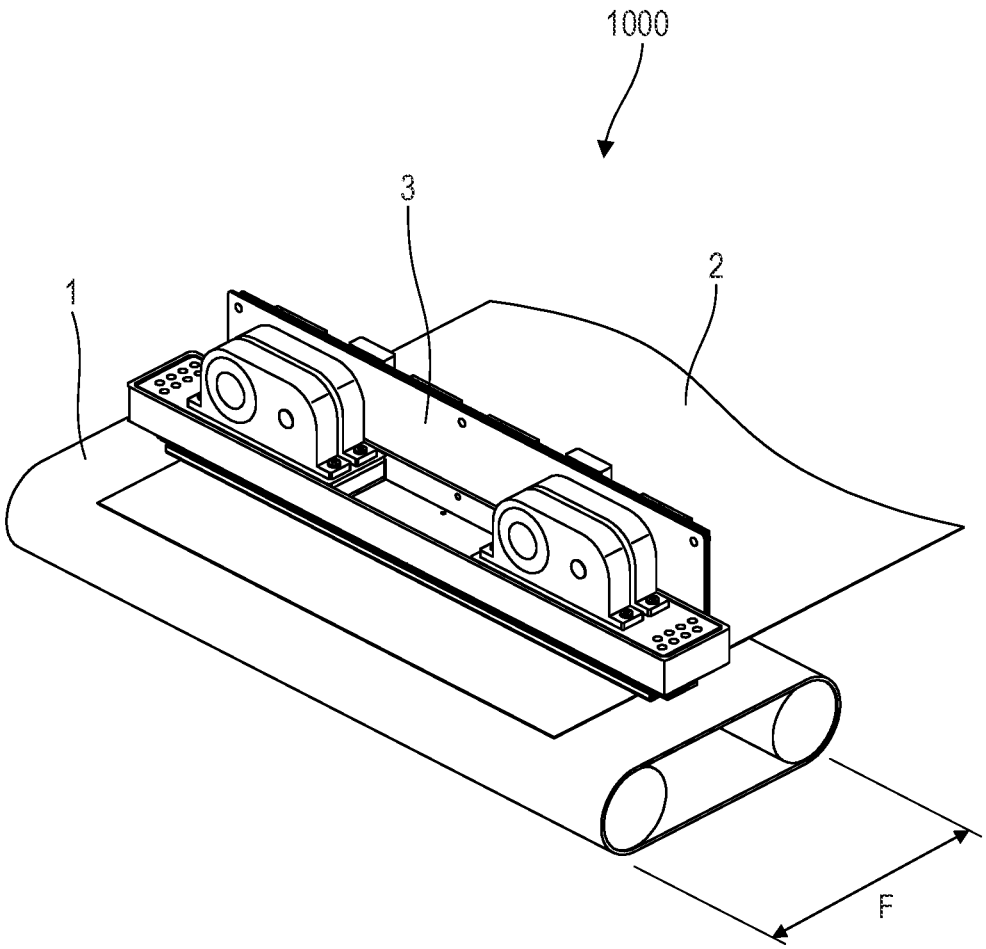
FIG. 1 is a perspective view illustrating a general configuration of a liquid ejection apparatus of one embodiment of the present invention.

FIG. 1 illustrates the liquid ejection apparatus of the present invention, in particular, a general configuration of an ink jet recording apparatus 1000 that ejects ink to perform recording (hereafter, also referred to as a recording apparatus). The recording apparatus 1000 has a conveyance unit 1 that conveys a recording medium 2 and a line type (page wide type) liquid ejection head 3 arranged substantially orthogonally to the conveyance direction of the recording medium. The recording apparatus 1000 is a line type recording apparatus that performs one-path continuous recording while conveying a plurality of recording media 2 continuously or intermittently. The recording medium 2 is not limited to a cut sheet and may be a continuous roll sheet. Further, the present invention is also applicable to an intermediate transfer type recording apparatus that first ejects a liquid from the liquid ejection head 3 onto an intermediate transfer member to form an image on the transfer member without ejecting the liquid directly onto a recording medium such as paper and then transfers the image onto a recording medium such as paper. The liquid ejection head 3 may be capable of color printing with cyan, magenta, yellow, and black (CMYK) ink, for example, and a liquid supply member configured to supply a liquid to the liquid ejection head 3 as described later, a main tank, and a buffer tank are fluidly connected. Further, an electrical control unit that transmits power and an ejection control signal to the liquid ejection head 3 is electrically connected to the liquid ejection head 3. Liquid paths and electrical signal paths inside the ejection head 3 will be described later.

(Description of First Circulation Path)

Figure 2:
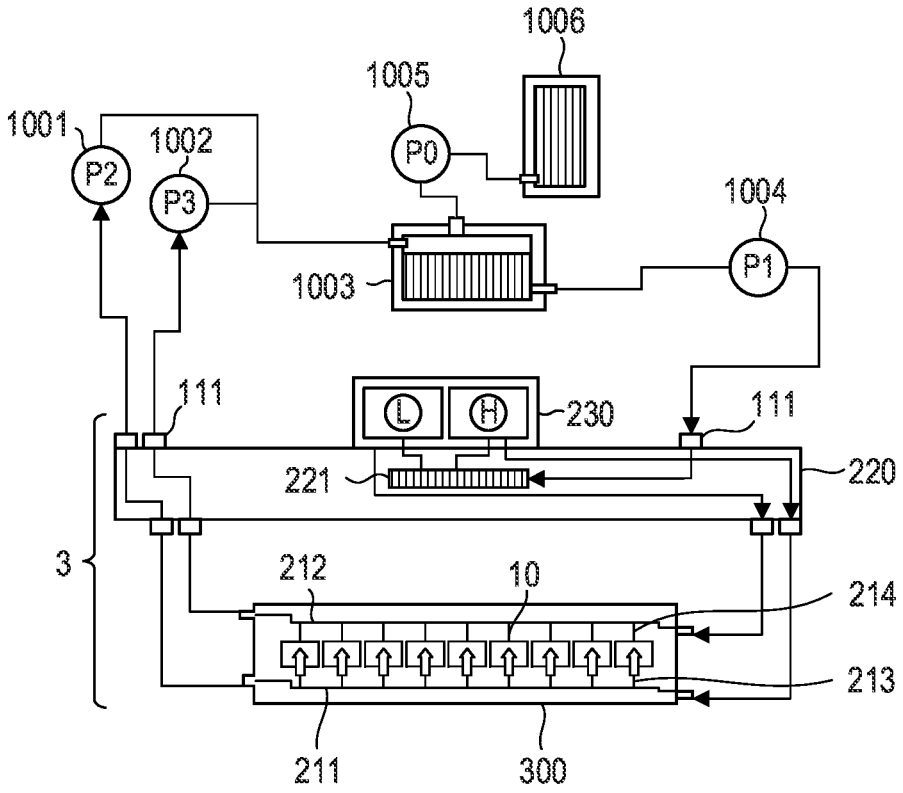
FIG. 2 is a diagram illustrating a circulation flow path of the liquid ejection apparatus illustrated in FIG. 1.

The recording apparatus 1000 of the present embodiment is an ink jet recording apparatus in a form that circulates a liquid such as ink between a tank and the liquid ejection head 3 described later. For example, a liquid can be circulated by activating two circulation pumps (a high pressure pump and a low pressure pump) in downstream of the liquid ejection head 3. This circulation form will be described below. FIG. 2 is a schematic diagram illustrating a first circulation path that is a form of a liquid path included in a recording apparatus of the present embodiment. The liquid ejection head 3 has a negative pressure control unit 230 that controls a pressure (negative pressure) inside the circulation path, a liquid supply unit 220 that fluidly communicates with the negative pressure control unit 230, and liquid connection portions 111 that serve as a supply port and a discharge port of ink to the liquid supply unit 220. Furthermore, the liquid ejection head 3 has a casing 80 (see FIG. 4) that encloses the circulation path. This liquid ejection head 3 is fluidly connected to a first circulation pump (high pressure side) 1001, a first circulation pump (low pressure side) 1002, a buffer tank 1003, and the like. In FIG. 2, although only the circulation path through which one color of ink of the CMYK ink flows is illustrated to simplify the illustration, circulation paths for four colors are provided to the liquid ejection head 3 and the recording apparatus body in the actual implementation. The buffer tank 1003 that is a sub-tank connected to a main tank 1006 has an outside-air communication port (not illustrated) that communicates between the inside and the outside of the tank and can discharge bubbles in the ink to the outside. The buffer tank 1003 is also connected to a replenishing pump 1005. The replenishing pump 1005 is provided between the buffer tank 1003 and the main tank 1006. When a liquid is ejected (discharged) from ejection orifices of the liquid ejection head due to recording by liquid ejection, suction recovery, or the like and the liquid is consumed by the liquid ejection head 3, the replenishing pump 1005 transports a liquid for the consumed amount from the main tank 1006 to the buffer tank 1003.

The two first circulation pumps 1001 and 1002 have a function of sucking a liquid from the liquid connection portion 111 of the liquid ejection head 3 and causing the liquid to flow to the buffer tank 1003. A positive-displacement pump having a constant liquid supply capability is preferable as the first circulation pump. Specifically, the first circulation pump may be a tube pump, a gear pump, a diaphragm pump, a syringe pump, or the like and may be in a form in which a common constant flow valve or relief valve is arranged at a pump outlet to ensure a constant flow rate, for example. A constant amount of ink is caused to flow inside a common supply path 211 and a common collection path 212, respectively, by the first circulation pump (high pressure side) 1001 and the first circulation pump (low pressure side) 1002 when the liquid ejection head 3 is driven. It is preferable to set this flow rate to a level at which a temperature difference between the recording element substrates 10 inside the liquid ejection head 3 does not affect the recording image quality. However, if an extremely large flow rate is set, this causes an excessively large negative pressure difference between the recording element substrates 10 and causes density unevenness of an image to occur due to influence of a pressure loss of a flow path inside a liquid ejection unit 300. It is therefore preferable to set a flow rate taking a temperature difference and a negative pressure difference between the recording element substrates 10 into consideration. By causing a liquid to flow in such a way, the temperature of the liquid ejection head 3 during liquid ejection is maintained at an optimal temperature.

The negative pressure control unit 230 is provided in the path between a second circulation pump 1004 and the liquid ejection unit 300. This has a function of operation to maintain the pressure on the downstream from the negative pressure control unit 230 (on the liquid ejection unit 300 side) at a fixed pressure set in advance even when the flow rate of the circulation system fluctuates due to a difference in ejection amount per unit area. As the two pressure adjustment mechanisms forming the negative pressure control unit 230, any mechanism may be used as long as it can control the pressure on the downstream thereof to exhibit only fluctuations within a certain range about a desired set pressure as the center. As an example, the same mechanism as a so-called "decompression regulator" may be employed. When a decompression regulator is used, it is preferable to pressurize the upstream of the negative pressure control unit 230 via the liquid supply unit 220 by using the second circulation pump 1004 as illustrated in FIG. 2. With such a configuration, it is possible to suppress the influence of a water head pressure of the buffer tank 1003 on the liquid ejection head 3, and it is therefore possible to increase flexibility in the layout of the buffer tank 1003 in the recording apparatus 1000. The second circulation pump 1004 may be any circulation pump as long as it has a head pressure above a certain pressure in a range of a liquid circulation flow rate used when the liquid ejection head 3 is driven, and a turbo type pump, a positive-displacement pump, or the like may be used. Specifically, a diaphragm pump or the like may be employed. Further, for example, a water head tank arranged with a certain water head difference to the negative pressure control unit 230 may be employed instead of the second circulation pump 1004.

The negative pressure control unit 230 has two pressure adjustment mechanisms for which different control pressures are set, respectively, as illustrated in FIG. 2. Out of the two negative pressure adjustment mechanisms, the relatively high pressure setting side (denoted as H in FIG. 2) and the relatively low pressure setting side (denoted as L in FIG. 2) are connected to the common supply path 211 and the common collection path 212 in the liquid ejection unit 300, respectively, via inside of the liquid supply unit 220. The liquid ejection unit 300 is provided with the common supply path (common supply flow path) 211, a common collection path (common collection flow path) 212, and an individual supply path (individual supply flow path) 213 and an individual collection path (individual collection flow path) 214 that communicate with each recording element substrate. Since the individual flow paths 213 and 214 communicate with the common supply path 211 and the common collection path 212, a flow in which a part of a liquid passes from the common supply path 211 through an internal flow path of the recording element substrates 10 and reaches the common collection path 212 (the arrow in FIG. 2) occurs. This is because the pressure adjustment mechanism H is connected to the common supply path 211, the pressure adjustment mechanism L is connected to the common collection path 212, and therefore a differential pressure occurs between the two common flow paths. A plurality of common supply paths 211 are provided in juxtaposition to each other along the longitudinal direction of the liquid ejection head 3.

According to these first circulation paths, a liquid in the main tank 1006 is supplied to the buffer tank 1003 by the replenishing pump 1005 and then supplied from the liquid connection portion 111 to the liquid supply unit 220 of the liquid ejection head 3 by the second circulation pump 1004. The liquid is then adjusted to have two different negative pressures (high pressure, low pressure) in the negative pressure control unit 230 connected to the liquid supply unit 220 and is divided into two flow paths of the high pressure side and the low pressure side and circulated therein. The liquid inside the liquid ejection head 3 is circulated inside the liquid ejection head 3 by the operation of the first circulation pump (high pressure side) 1001 and the first circulation pump (low pressure side) 1002 on the downstream of the liquid ejection head 3, is discharged outside the liquid ejection head 3 from the liquid connection portion 111, and returns to the buffer tank 1003.

In such a way, in the liquid ejection unit 300, a flow in which a part of a liquid passes through each recording element substrate 10 while the liquid flows so as to pass through the common supply path 211 and the common collection path 212, respectively, is generated. It is therefore possible to discharge heat generated by each recording element substrate 10 to the outside of the recording element substrate 10 by using ink flowing in the common supply path 211 and the common collection path 212. Further, with such a configuration, it is possible to generate an ink flow also in ejection orifices or pressure chambers which are not performing ejection when the liquid ejection head 3 is performing recording. This can reduce the viscosity of ink thickened in ejection orifices and suppress thickening of the ink. Further, it is possible to discharge the thickened ink and a foreign material in the ink to the common collection path 212. Thus, the liquid ejection head 3 of the present embodiment enables fast recording at high image quality.

(Description of Configuration of Liquid Ejection Head)

Figure 3A:
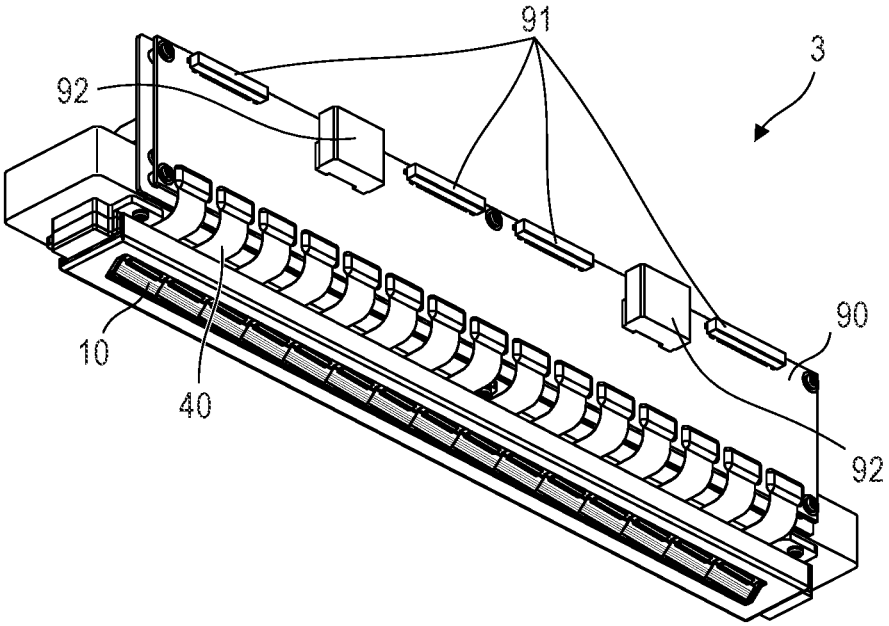
FIG. 3A is a perspective view of a liquid ejection head of a first embodiment of the present invention when viewed from a side of a face on which ejection orifices are formed.
Figure 3B:
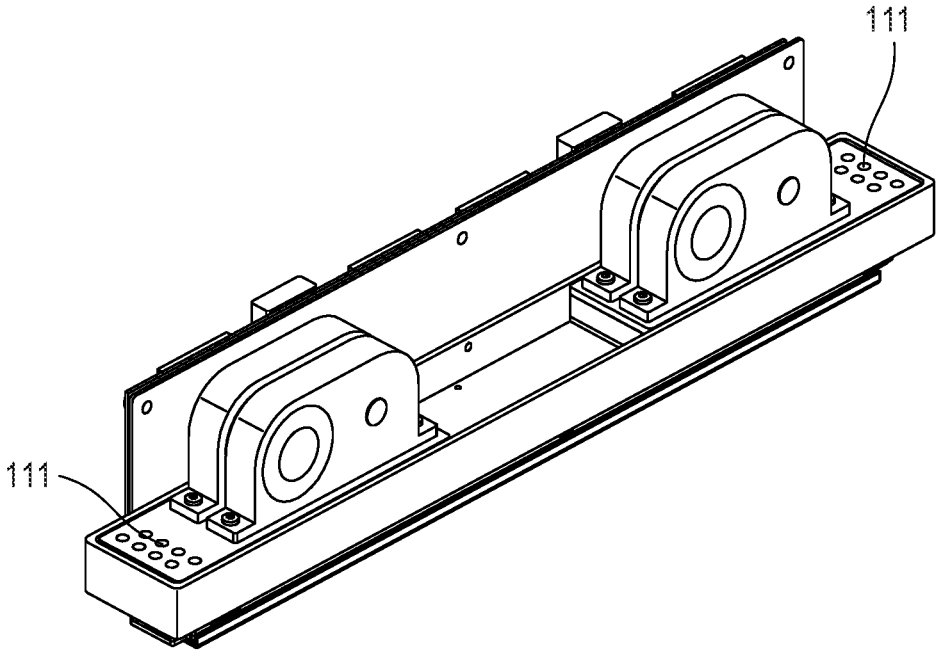
FIG. 3B is a perspective view when viewed from a direction opposite to FIG. 3A.

The configuration of the liquid ejection head 3 of the present embodiment will be described. FIG. 3A and FIG. 3B are perspective views illustrating the liquid ejection head 3 of the present embodiment. The liquid ejection head 3 is a line type liquid ejection head in which 15 recording element substrates 10, each of which can eject four colors of ink of cyan C/magenta M/yellow Y/black K, are aligned in a straight line (arranged inline). As illustrated in FIG. 3A, the liquid ejection head 3 has respective recording element substrates 10 and has a signal input terminal 91 and a power supply terminal 92 electrically connected via a flexible wiring board 40 and an electrical wiring board 90. The signal input terminal 91 and the power supply terminal 92 are electrically connected to a control unit of the recording apparatus 1000 and supply ejection drive signals and power required for ejection to the recording element substrates 10, respectively. With the wirings being aggregated by an electrical circuit inside the electrical wiring board 90, the number of signal input terminals 91 and power supply terminals 92 can be less than the number of recording element substrates 10. This can reduce the number of electrical connection portions required to be disconnected when the liquid ejection head 3 is assembled to the recording apparatus 1000 or when the liquid ejection head 3 is replaced. As illustrated in FIG. 3B, the liquid connection portions 111 provided at both ends of the liquid ejection head 3 are connected to a liquid supply system of the recording apparatus 1000. Accordingly, four colors of ink, cyan C/magenta M/yellow Y/black K, are supplied from the supply system of the recording apparatus 1000 to the liquid ejection head 3, and ink that has passed through the liquid ejection head 3 is collected to the supply system of the recording apparatus 1000. The ink of each color can be circulated via the path in the recording apparatus 1000 and the path in the liquid ejection head 3 as described above.

Figure 4:
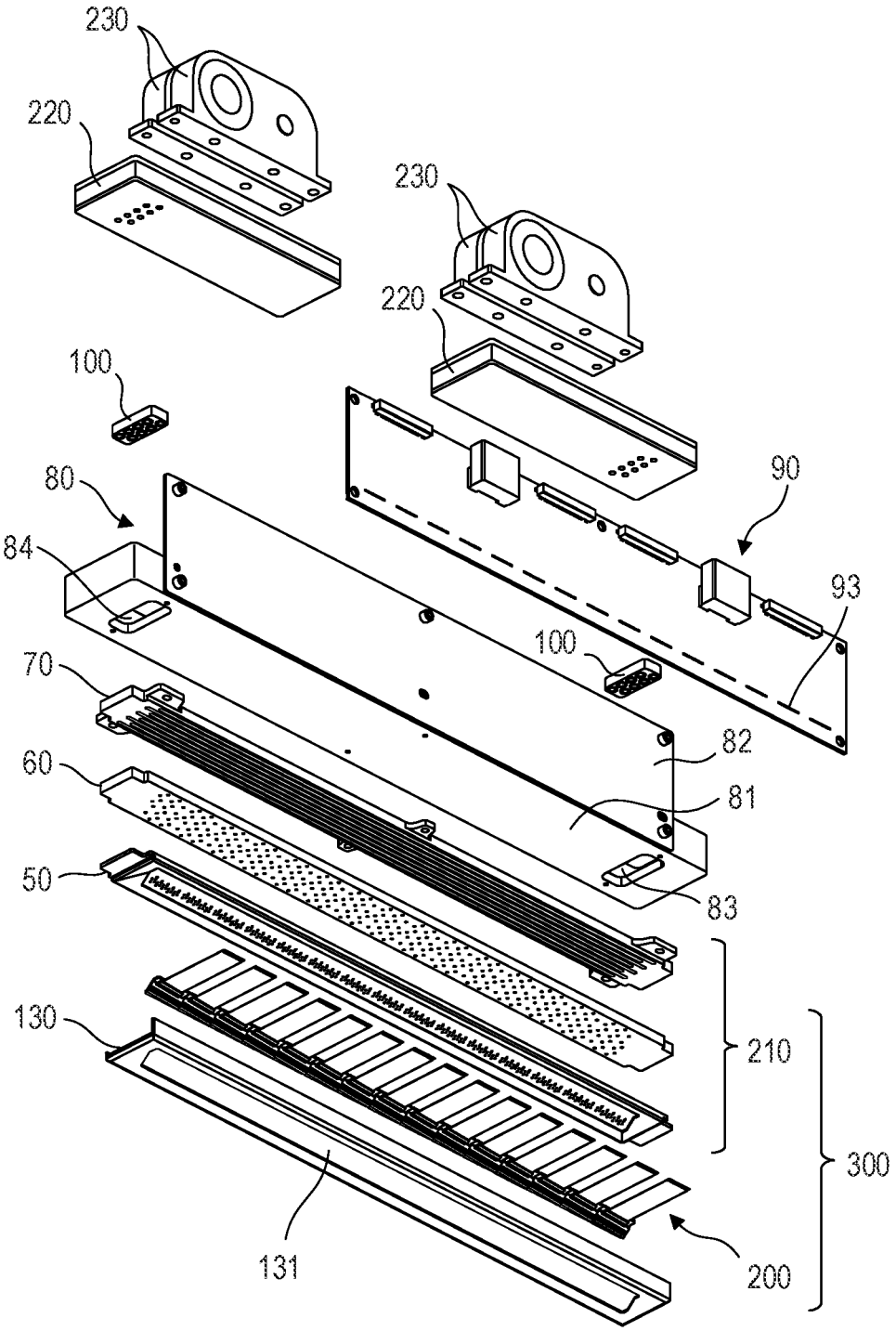
FIG. 4 is an exploded perspective view of a liquid ejection head of the first embodiment of the present invention.

FIG. 4 is an exploded perspective view illustrating respective components or units forming the liquid ejection head 3. The liquid ejection unit 300, the liquid supply units 220, and the electrical wiring board 90 are attached to the casing 80. The liquid connection portion 111 (see FIG. 3B) is provided to the liquid supply units 220, and filters 221 for respective colors (see FIG. 2) communicating with respective openings of the liquid connection portion 111 are provided inside the liquid supply units 220 in order to remove a foreign material in supplied ink. The filters 221 for two colors are provided to each of the two liquid supply units 220. A liquid that has passed through the filter 221 is supplied to the negative pressure control units 230 arranged above the liquid supply units 220 in association with respective colors. The negative pressure control unit 230 is a unit formed of negative pressure control valves for respective colors and generates the following effects from operations of a valve, a spring member, or the like provided inside each negative pressure control unit 230. That is, the negative pressure control unit 230 significantly attenuates a change in the pressure loss inside the supply system (the supply system on the upstream of the liquid ejection head 3) of the recording apparatus 1000 that occurs due to fluctuations of the flow rate of a liquid. Accordingly, it is possible to stabilize the negative pressure change on the downstream from the negative pressure control unit 230 (on the liquid ejection unit 300 side) to be within in a certain constant range. Two negative pressure control valves are built in on a color basis inside the negative pressure control unit 230 for each color, as illustrated in FIG. 2. The two negative pressure control valves are set for different control pressures, and the high pressure side and the low pressure side communicate with the common supply path 211 (see FIG. 2) and the common collection path 212 (see FIG. 2) in the liquid ejection unit 300 via the liquid supply unit 220, respectively.

The casing 80 is formed of a liquid ejection unit support portion 81 and an electrical wiring board support portion 82, supports the liquid ejection unit 300 and the electrical wiring board 90, and ensures rigidity of the liquid ejection head 3. The electrical wiring board support portion 82 is used for supporting the electrical wiring board 90 and fixed to the liquid ejection unit support portion 81 by screwing. The liquid ejection unit support portion 81 has a function of restricting a warp or deformation of the liquid ejection unit 300 to ensure the relative position accuracy of the plurality of recording element substrates 10 and thereby suppresses occurrence of a stripe or unevenness in a recorded material. It is therefore preferable that the liquid ejection unit support portion 81 have sufficient rigidity, and a preferable material may be a metal material such as stainless (SUS) or aluminum or ceramic such as alumina. The liquid ejection unit support portion 81 is provided with openings 83 and 84 in which a joint rubber 100 is inserted. A liquid supplied from the liquid supply unit 220 is guided to a third flow path member 70 forming the liquid ejection unit 300 via the joint rubber.

The liquid ejection unit 300 has a plurality of ejection modules 200 and a flow path member 210, and a cover member 130 is attached to a face of the liquid ejection unit 300 on the recording medium side. Herein, the cover member 130 is a member having a frame-like surface provided with a long opening 131 as illustrated in FIG. 4, and the recording element substrates 10 and a sealing member 110 included in the ejection module 200 (see FIG. 7A described later) are exposed from the opening 131. The frame portion around the opening 131 has a function as a contact face of a cap member that caps the liquid ejection head 3 during standby for recording. It is thus preferable to apply an adhesive agent, a sealing material, a filler, or the like along the circumference of the opening 131 to fill unevenness or a gap in an ejection orifice surface of the liquid ejection unit 300 and thereby cause a closed space to be formed when capped.

Next, the configuration of the flow path member 210 included in the liquid ejection unit 300 will be described. As illustrated in FIG. 4, the flow path member 210 is formed of a stack of the first flow path member 50, the second flow path member 60, and the third flow path member 70 and distributes a liquid supplied from the liquid supply unit 220 to each ejection module 200. Further, the flow path member 210 returns a liquid refluxed from the ejection module 200 to the liquid supply unit 220. The flow path member 210 is fixed to the liquid ejection unit support portion 81 by screwing, and thereby a warp or deformation of the flow path member 210 is suppressed.

Figure 5A:
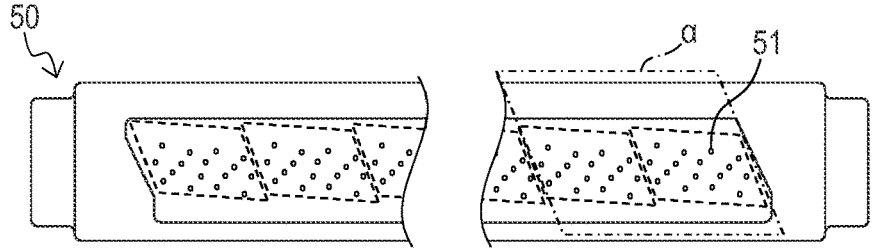
FIG. 5A is a plan view illustrating a face of a first flow path member viewed from a side on which ejection modules are mounted.
Figure 5B:
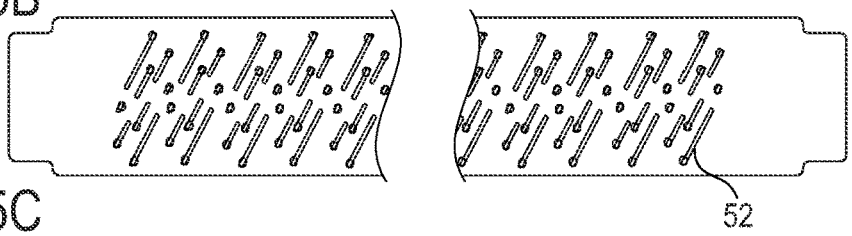
FIG. 5B is a plan view illustrating a contact face of the first flow path member coming into contact with a second flow path member.
Figure 5C:
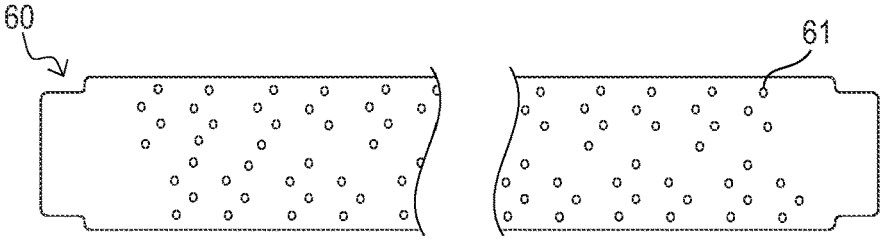
FIG. 5C is a plan view illustrating a contact face of the second flow path member coming into contact with the first flow path member.
Figure 5D:
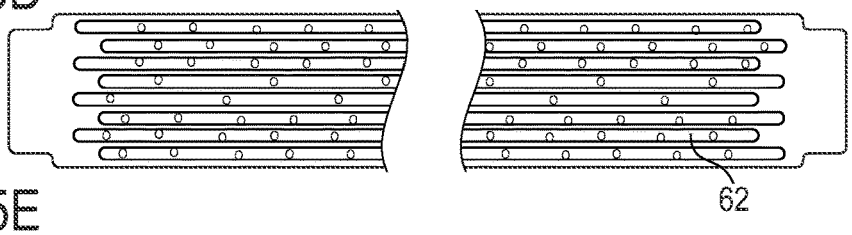
FIG. 5D is a plan view illustrating a contact face of the second flow path member coming into contact with a third flow path member.
Figure 5E:
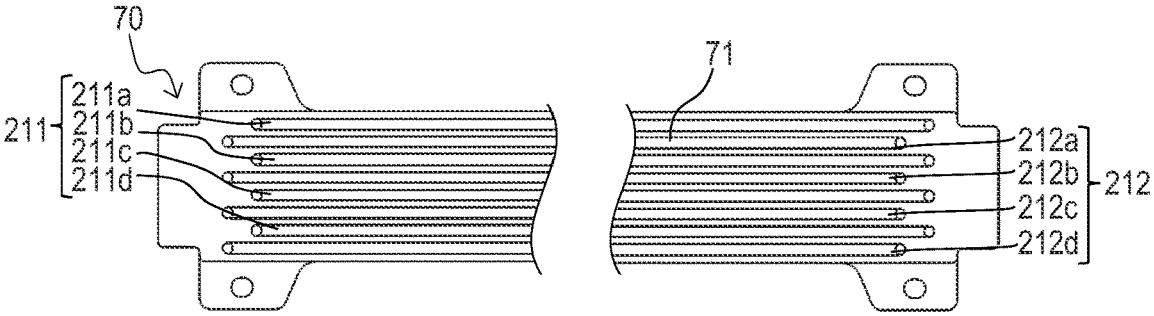
FIG. 5E is a plan view illustrating a contact face of the third flow path member coming into contact with the second flow path member.
Figure 5F:
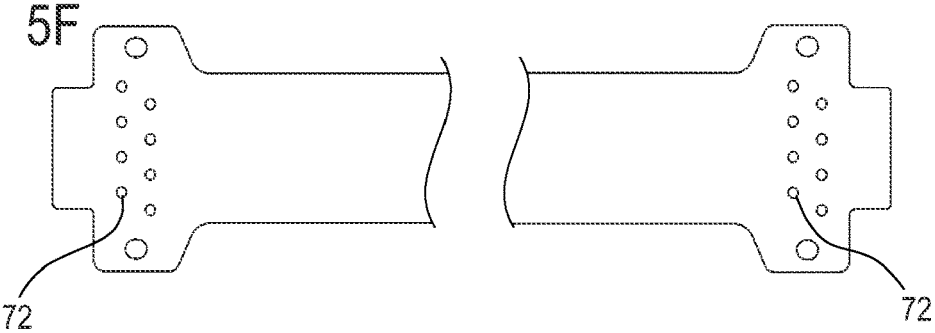
FIG. 5F is a plan view illustrating a face of the third flow path member viewed from a side which comes into contact with a liquid ejection unit support portion.

FIG. 5A to FIG. 5F are diagrams illustrating the front surface and the back surface of each of the first to third flow path members 50, 60, and 70. FIG. 5A illustrates a face of the first flow path member 50 viewed from a side on which the ejection modules 200 are mounted, and FIG. 5F illustrates a face of the third flow path member 70 viewed from a side which comes into contact with the liquid ejection unit support portion 81. The first flow path member 50 and the second flow path member 60 are joined such that the face illustrated in FIG. 5B and the face illustrated in FIG. 5C, which are respective contact faces, face each other. The second flow path member 60 and the third flow path member 70 are joined such that the face illustrated in FIG. 5D and the face illustrated in FIG. 5E, which are respective contact faces, face each other. With the second flow path member 60 and the third flow path member 70 being joined, eight common flow paths 211*a*, 211*b*, 211*c*, 211*d*, 212*a*, 212*b*, 212*c*, and 212*d* extending in the longitudinal direction of the flow path members 60 and 70 from common flow path grooves 62 and 71 formed in each member are formed, respectively. Thereby, a set of the common supply path 211 and the common collection path 212 for each color is formed inside the flow path member 210. Ink is supplied from the common supply path 211 to the liquid ejection head 3, and the ink supplied to the liquid ejection head 3 is collected through the common collection path 212. Communication ports 72 of the third flow path member 70 (see FIG. 5F) communicate with respective holes of the joint rubber 100 and fluidly communicate with the liquid supply unit 220 (see FIG. 4). A plurality of communication ports 61 (communication ports communicating with the common supply path 211 and communication ports communicating with the common collection path 212) are each formed in each bottom face of the common flow path grooves 62 of the second flow path member 60 and communicate with one end of each individual flow path groove 52 of the first flow path member 50. Communication ports 51 are each formed at the other end of each individual flow path groove 52 of the first flow path member 50 and fluidly communicate with the plurality of ejection modules 200 via the communication ports 51. With these individual flow path grooves 52, it is possible to aggregate flow paths on the center side of the flow path member. Individual flow paths 213 and 214 are formed of the grooves 52, which are formed on the face of the first flow path member 50 on the recording element substrate side, and holes (communication ports 51), which communicate with the grooves 52 and are opened in the face of the first flow path member 50 on the side opposite to the recording element substrate side.

It is preferable that the first to third flow path members 50 to 70 be corrosion-resistant against liquids and be made of a low linear expansion material. For example, alumina may be used as the material. Further, a composite material (resin material) in which an inorganic filler such as silica fine particles or fibers is added to a base material of LCP (liquid crystal polymer), PPS (polyphenylsulfide), PSF (polysulfone), or modified PPE (polyphenylene ether) may be preferably used. The flow path member 210 may be formed by stacking and adhering the three flow path members 50, 60, and 70 to each other, and when the flow path members 50, 60, and 70 made of a resin composite resin material are used, the flow path member 210 may be formed by melting these members with each other.

Figure 6:
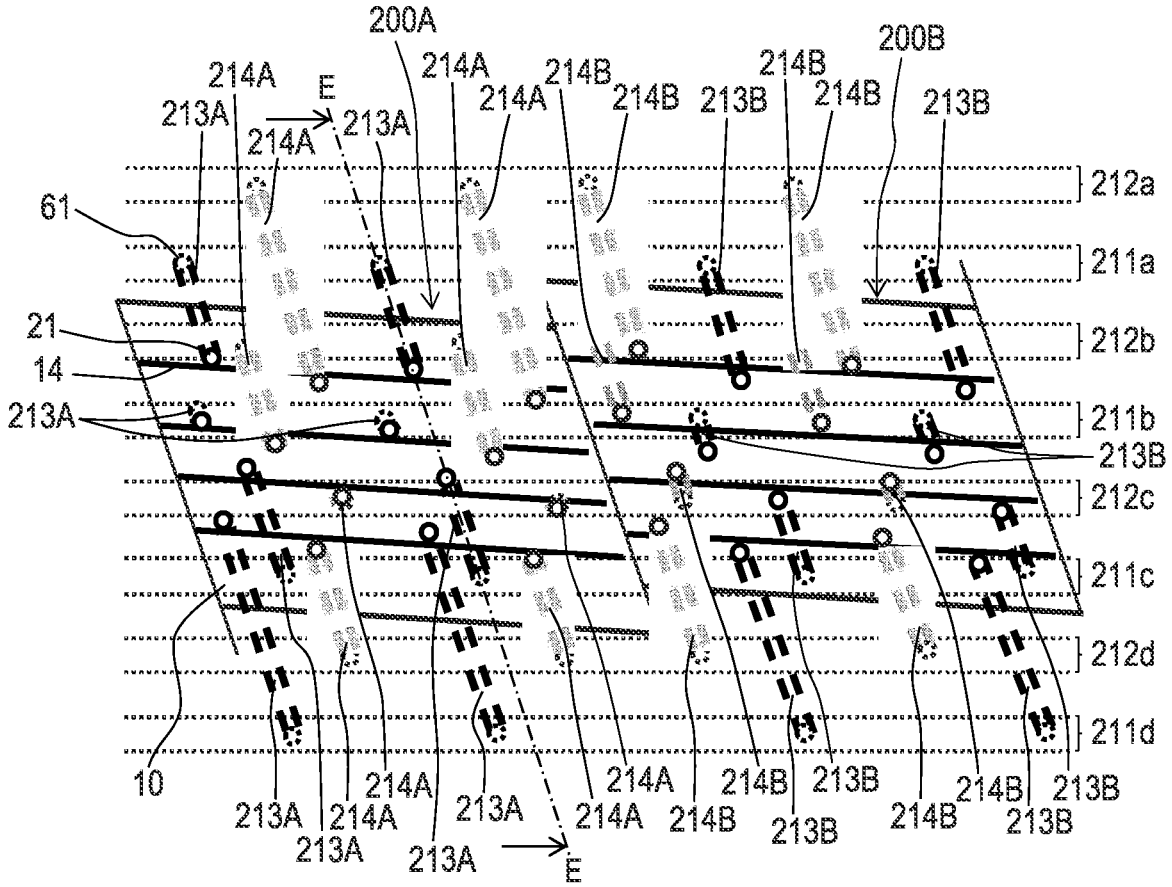
FIG. 6 is a perspective projection illustrating a connection relationship of flow path members of the first embodiment of the present invention.

FIG. 6 illustrates the part a of FIG. 5A and is a partially enlarged perspective projection of flow paths inside the flow path member 210, which are formed by joining the first to third flow path members 50, 60, and 70, when viewed from a side of the face of the first flow path member 50 on which the ejection modules 200A and 200B are mounted. A plurality of common supply paths 211 and a plurality of common collection paths 212 are arranged so as to be aligned alternatingly in a direction orthogonal to respective flow paths 211 and 212 (the vertical direction of FIG. 6) of the flow path member 210. The connection relationship of respective flow paths inside the flow path member 210 will be described. In the flow path member 210, the common supply paths 211 (211*a*, 211*b*, 211*c*, 211*d*) and the common collection paths 212 (212*a*, 212*b*, 212*c*, 212*d*) extending along the longitudinal direction of the liquid ejection head 3 are provided for respective colors. A plurality of individual supply paths 213 formed of the individual flow path grooves 52 are connected to the common supply paths 211 for respective colors via the communication ports 61. Further, a plurality of individual collection paths 214 formed of the individual flow path grooves 52 are connected to the common collection paths 212 for respective colors via the communication ports 61. In FIG. 6, the individual supply paths and the individual collection paths connected to the ejection module 200A are denoted with references 213A and 214A, and the individual supply paths and the individual collection paths connected to the ejection module 200B are denoted with references 213B and 214B. With such a flow path configuration, ink can be aggregated from each common supply path 211 to the recording element substrate 10 located in the center of the flow path member via the individual supply path 213. Further, ink can be collected from the recording element substrate 10 to each common collection path 212 via the individual collection path 214.

As illustrated in FIG. 2, the common supply path 211 for each color is connected to the negative pressure control unit 230 (high pressure side) for a corresponding color via the liquid supply unit 220, and the common collection path 212 is connected to the negative pressure control unit 230 (low pressure side) via the liquid supply unit 220. The negative pressure control unit 230 causes a differential pressure (pressure difference) between the common supply path 211 and the common collection path 212. Thus, a flow flowing through the common supply path 211, the individual supply paths 213, the recording element substrates 10, the individual collection paths 214, and the common collection path 212 in this order occurs for each color inside the liquid ejection head of the present embodiment in which respective flow paths are connected as illustrated in FIG. 6.

(Description of Ejection Module)

Figure 7A:
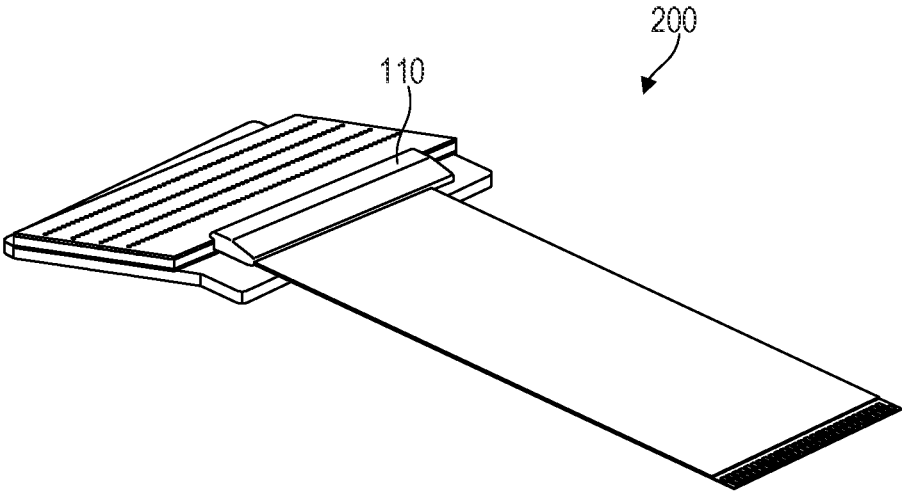
FIG. 7A is a perspective view of the ejection module of the liquid ejection head of the first embodiment of the present invention.
Figure 7B:
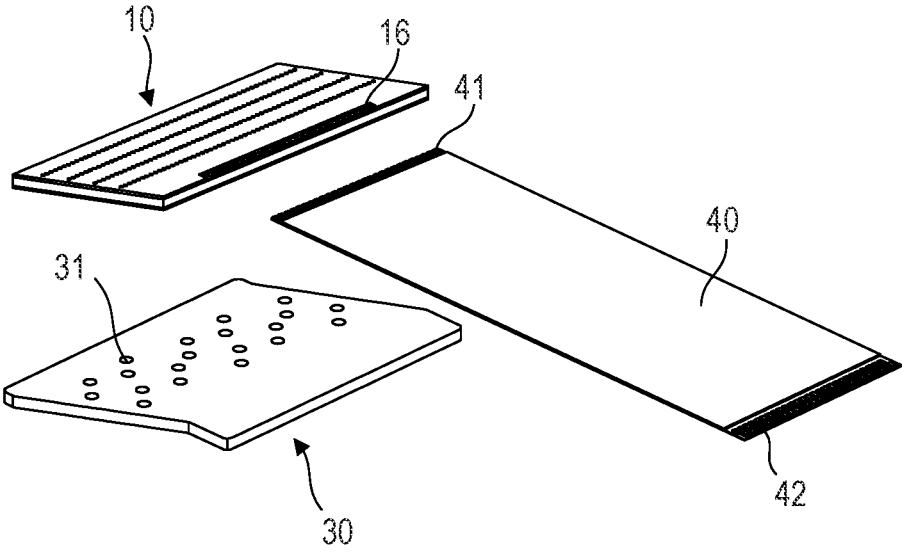
FIG. 7B is an exploded perspective view thereof.

FIG. 7A is a perspective view of the ejection module 200, and FIG. 7B is an exploded perspective view thereof. In a manufacturing method of the ejection module 200, first, the recording element substrate 10 and the flexible wiring board 40 are adhered onto a support member 30 in which liquid communication ports 31 are provided in advance. Then, a terminal 16 of the recording element substrate 10 and a terminal 41 of the flexible wiring board 40 are electrically connected by wire bonding, and the wire bonding portion (electrical connection portion) is then covered and sealed with a sealing member 110. A terminal 42 of the flexible wiring board 40 opposite to the recording element substrate 10 is electrically connected to the connection terminal 93 (see FIG. 4) of the electrical wiring board 90. Since the support member 30 is a supporter that supports the recording element substrate 10 and also is a flow path member that causes the recording element substrate 10 and the flow path member 210 to fluidly communicate with each other, it is preferable for the support member 30 to have high flatness and be able to be sufficiently reliably joined to the recording element substrate. For example, alumina or a resin material is preferable as the material.

(Description of Structure of Recording Element Substrate)

Figure 8A:
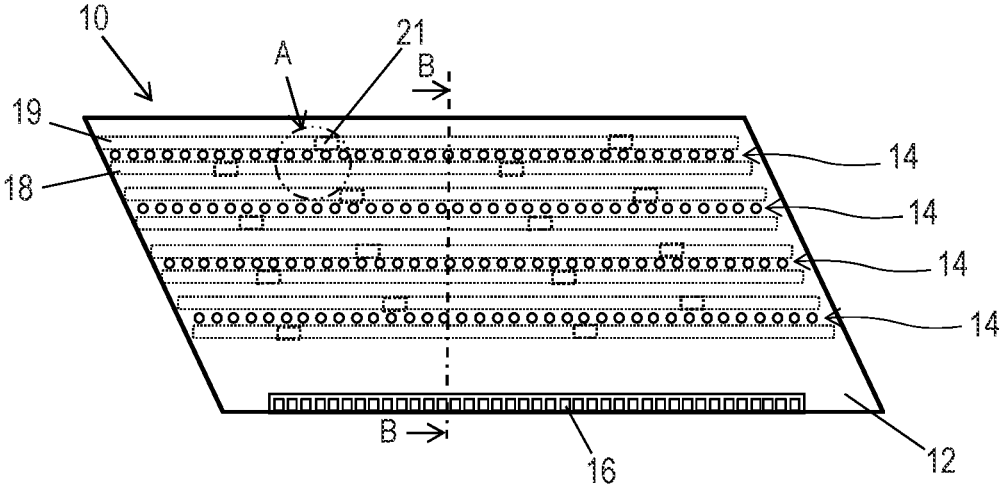
FIG. 8A is a plan view of a face of a recording element substrate viewed from a side on which ejection orifices are formed.
Figure 8B:
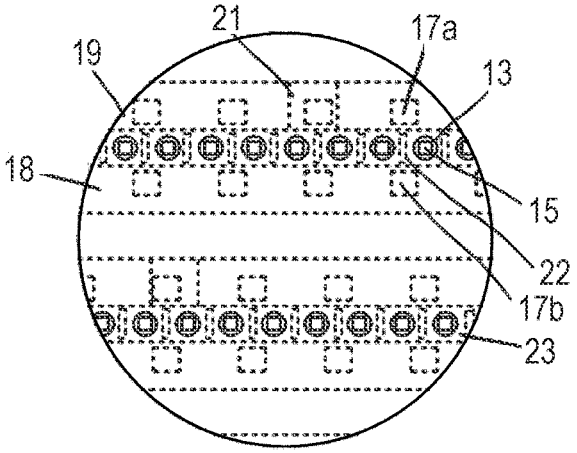
FIG. 8B is an enlarged view of a portion illustrated in a region A of FIG. 8A.
Figure 8C:
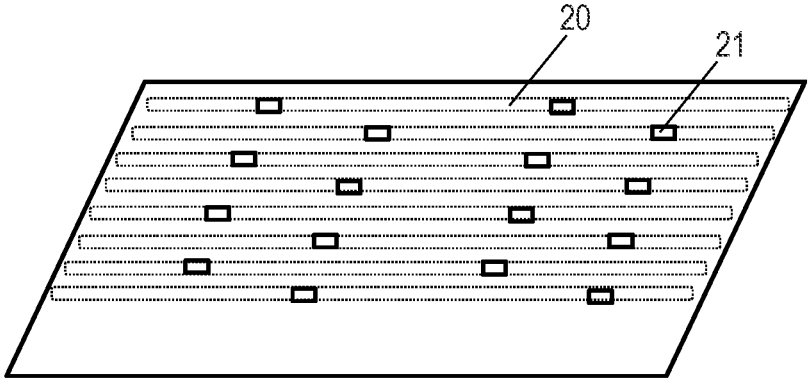
FIG. 8C is a plan view on a side corresponding to a back surface of FIG. 8A.
Figure 9:
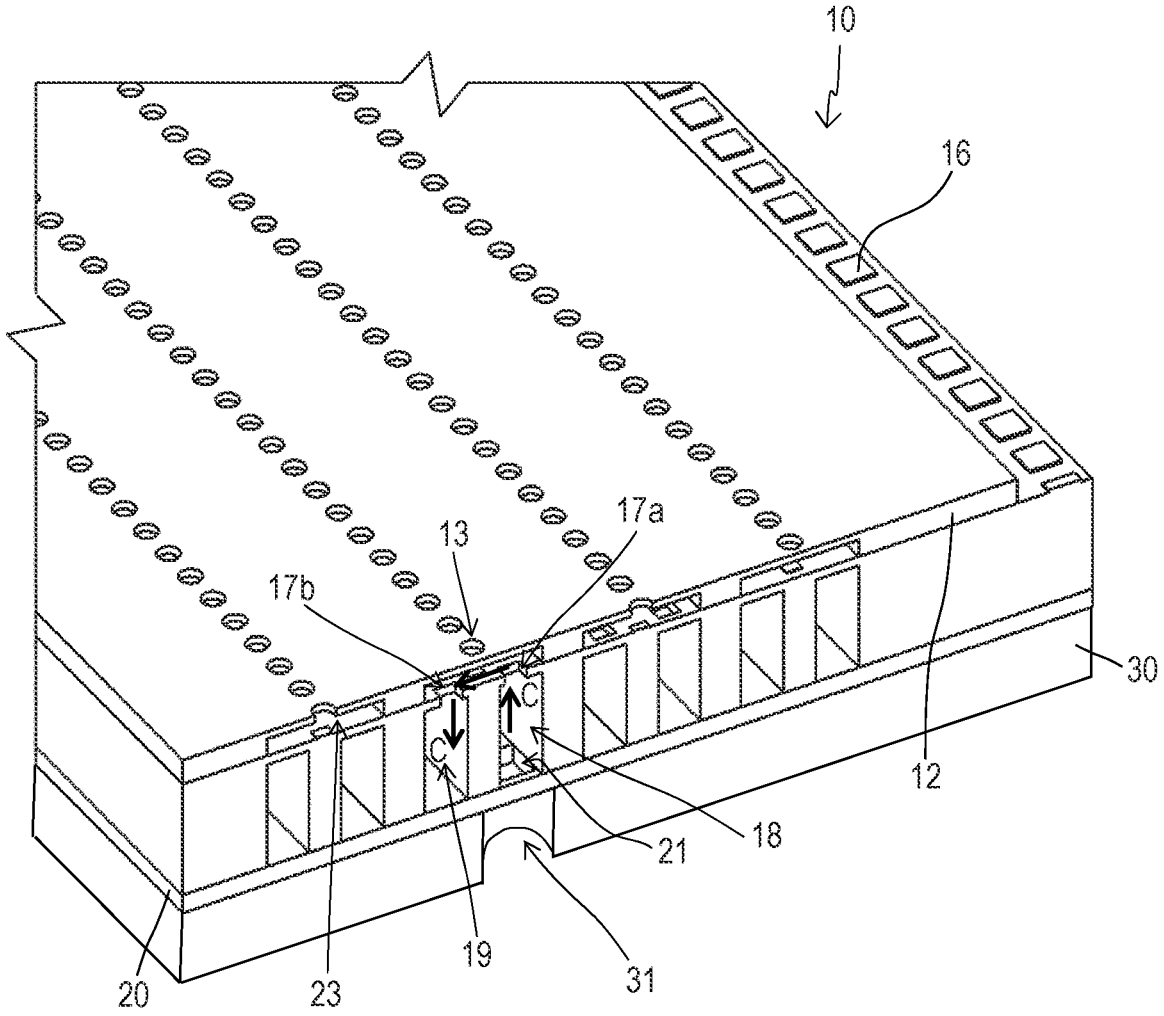
FIG. 9 is a partially cut-out perspective view of the recording element substrate of the liquid ejection head of the first embodiment of the present invention.

FIG. 8A is a plan view illustrating a face of the recording element substrate 10 viewed from a side on which ejection orifices 13 are formed, FIG. 8B is an enlarged plan view of a portion A of FIG. 8A, and FIG. 8C is a backside view thereof. FIGS. 8A, 8B, and 8C schematically illustrate the overview of a liquid ejection head to which the present invention is applied. FIG. 9 is a sectional view taken along a line B-B of FIG. 8A. Four ejection orifice arrays 14 corresponding to respective colors of ink are formed in an ejection orifice-forming member 12 of the recording element substrate 10 illustrated in FIG. 8A. The direction in which the ejection orifice array 14 in which a plurality of ejection orifices 13 are aligned extends is referred to as "array direction of the ejection orifice array". As illustrated in FIG. 8B, recording elements 15 that are energy generating elements to generate energy for liquid ejection are arranged at positions corresponding to respective ejection orifices 13. An example of the recording element 15 is a heat generating element that generates thermal energy to foam a liquid.

Pressure chambers 23 each including the recording element 15 therein are partitioned by isolation walls 22. The recording elements 15 are electrically connected to the terminal 16 by electrical wirings (not illustrated) provided to the recording element substrate 10. Further, each recording element 15 generates heat based on a pulse signal input from the control circuit of the recording apparatus 1000 via the electrical wiring board 90 (see FIG. 4) and the flexible wiring board 40 (see FIG. 7B) and boils a liquid inside the pressure chamber 23. A liquid is ejected from the ejection orifices 13 by the foaming force due to the boiling. As illustrated in FIG. 8B, along each ejection orifice array 14, a liquid supply path 18 extends on one side of each ejection orifice array 14, and a liquid collection path 19 extends on the other side of each ejection orifice array 14. The liquid supply path 18 and the liquid collection path 19 are flow paths extending in the array direction of the ejection orifice array provided in the recording element substrate 10 and communicate with the pressure chambers 23 and the ejection orifices 13 via the supply port 17*a* and the collection port 17*b*, respectively.

As illustrated in FIG. 8C and FIG. 9, a sheet-like cover member 20 is stacked on the back surface of the recording element substrate 10, namely, the face opposite to the face in which the ejection orifices 13 are formed, and a plurality of openings 21 communicating with the liquid supply path 18 and the liquid collection path 19 are provided in the cover member 20. In the present embodiment, two openings 21 for one liquid supply path 18 and two openings 21 for one liquid collection path 19 are provided, respectively, in the cover member 20. As illustrated in FIG. 8B, respective openings 21 of the cover member 20 communicate with a plurality of communication ports 51 illustrated in FIG. 5A. It is preferable for the cover member 20 to be sufficiently corrosion-resistant against liquids, and it is required for the shape and the position of the openings 21 to be highly accurate in terms of preventing color mixture. It is therefore preferable to provide the openings 21 by photolithography process by using a photosensitive resin material or silicon as the material of the cover member 20. As described above, the cover member 20 is to convert the pitch of flow paths by the openings 21, a small thickness is desirable taking a pressure loss into consideration, and it is desirable to be formed of a film-like member.

The flow of a liquid inside the recording element substrate 10 will be described with reference to FIG. 9. In the recording element substrate 10, a substrate 11 formed of Si and the ejection orifice-forming member 12 formed of a photosensitive resin are stacked, and the cover member 20 is joined to the back surface of the substrate 11. The recording elements 15 are formed on one face side of the substrate 11 (see FIG. 8A), grooves forming the liquid supply paths 18 and the liquid collection paths 19 extending along the ejection orifice arrays 14 are formed on the back surface side thereof. The cover member 20 has a function as a cover forming a part of the walls of the liquid supply paths 18 and the liquid collection paths 19 formed in the substrate 11 of the recording element substrate 10. The liquid supply path 18 and the liquid collection path 19 defined by the substrate 11 and the cover member 20 are connected to the common supply path 211 and the common collection path 212 inside the flow path member 210, respectively, and a differential pressure occurs between the liquid supply path 18 and the liquid collection path 19. For the ejection orifices 13 which do not perform ejection when the liquid is ejected from some of the ejection orifices 13 to perform recording, the liquid inside the liquid supply path 18 provided inside the substrate 11 flows to the liquid collection path 19 via the supply ports 17*a*, the pressure chambers 23, and the collection ports 17*b* due to the differential pressure (the arrow C in FIG. 9). This flow enables collection of thickened ink caused by evaporation from the ejection orifices 13, a bubble, a foreign material, or the like into the liquid collection path 19 in the ejection orifices 13 or the pressure chambers 23 currently not used for recording. Further, it is possible to suppress thickening of ink in the ejection orifices 13 and the pressure chambers 23. The liquid collected to the liquid collection path 19 passes through the openings 21 of the cover member 20 and the liquid communication ports 31 of the support member 30 (FIG. 7B), is collected into the communication ports 51, the individual collection paths 214, and the common collection path 212 inside the flow path member 210 in this order, and is then collected into a collection path of the recording apparatus 1000.

The liquid supplied from the recording apparatus body to the liquid ejection head 3 is supplied and collected while fluidly moving in the following order. As illustrated in FIG. 2 to FIG. 5F, first, the liquid flows into the liquid ejection head 3 from the liquid connection portion 111 of the liquid supply unit 220. The liquid is supplied to the joint rubber 100, the communication ports 72 and the common flow path grooves 71 provided in the third flow path member 70, the common flow path grooves 62 and the communication ports 61 provided in the second flow path member 60, and the individual flow path grooves 52 and the communication ports 51 provided in the first flow path member 50 in this order. The liquid is then supplied to the pressure chambers 23 through the liquid communication ports 31 provided in the support member 30 (see FIG. 7B), the openings 21 provided in the cover member 20 (see FIG. 8A), and the liquid supply path 18 and the supply ports 17*a* provided in the substrate 11 in this order. A liquid not ejected from the ejection orifices 13 out of the liquid supplied to the pressure chambers 23 flows through the collection ports 17*b* and the liquid collection path 19 provided in the substrate 11, the openings 21 provided in the cover member 20, and the liquid communication ports 31 provided in the support member 30 in this order. The liquid then flows through the communication ports 51 and the individual flow path grooves 52 provided in the first flow path member 50, the communication ports 61 and the common flow path grooves 62 provided in the second flow path member 60, the common flow path grooves 71 and the communication ports 72 provided in the third flow path member 70, and the joint rubber 100 in this order. The liquid then flows out of the liquid connection portion 111 provided to the liquid supply unit 220 to the outside of the liquid ejection head 3.

In the circulation path illustrated in FIG. 2, the liquid flowing from the liquid connection portion 111 into the liquid ejection head 3 is supplied to the joint rubber 100 after routed through the negative pressure control unit 230. Further, in the circulation path of a modified example (not illustrated), a liquid that has been transferred and collected from the pressure chambers 23 flows out of the liquid connection portion 111 to the outside of the liquid ejection head via the negative pressure control unit 230 after passing through the joint rubber 100. In both the cases, not the whole inflow liquid from one end of the common supply path 211 of the liquid ejection unit 300 is supplied to the pressure chambers 23 via the individual supply paths 213. That is, a part of the inflow liquid from one end of the common supply path 211 flows out of the other end of the common supply path 211 to the liquid supply unit 220 without flowing into the individual supply paths 213. In such a way, because paths in which a liquid flows without via the recording element substrates 10 are provided, even when the recording element substrates 10 having fine flow paths having a large flow path resistance as with the present embodiment are provided, a reverse flow of the liquid circulation flow can be suppressed. Accordingly, in the liquid ejection head 3 of the present embodiment, since thickening of a liquid near the pressure chambers 23 or the ejection orifices 13 can be suppressed, instability in the direction of liquid ejection or an ejection failure can be suppressed, and as a result, recording with high image quality can be performed.

(Description of Positional Relationship Between Adjacent Recording Element Substrates)

Figure 10:
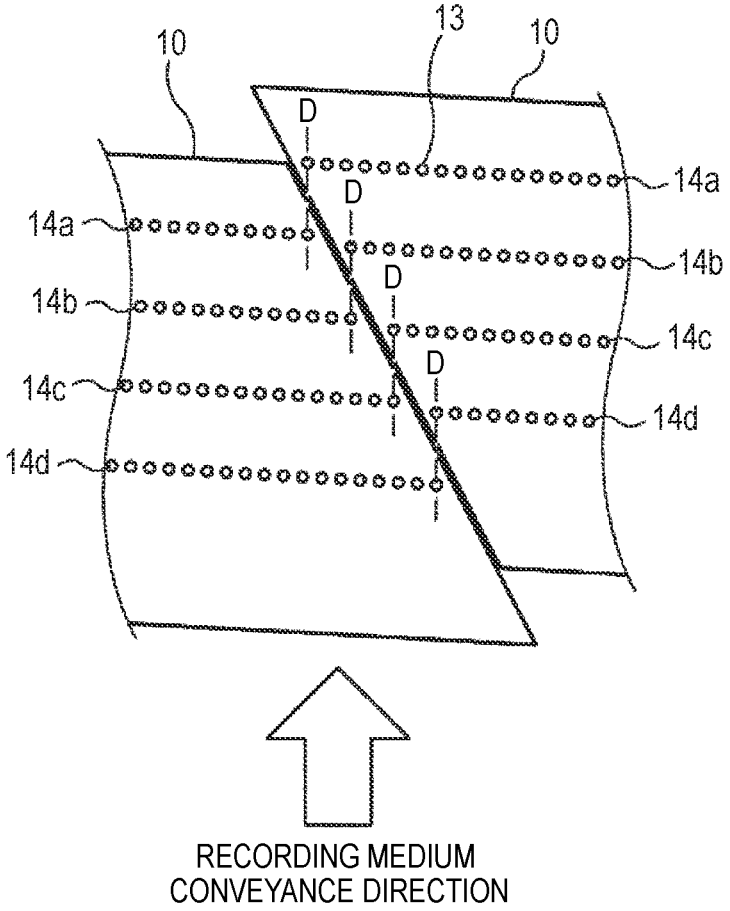
FIG. 10 is an enlarged plan view of a main portion illustrating an adjoining part of adjacent two recording element substrates of the liquid ejection head of the first embodiment of the present invention.

FIG. 10 is an enlarged plan view illustrating a portion where the recording element substrates 10 of the adjacent two ejection modules 200A and 200B are adjacent to each other. The recording element substrates 10 each shaped in substantially a parallelogram are used in the present embodiment. Each of ejection orifice arrays 14*a* to 14*d* formed of the plurality of ejection orifices 13 of each recording element substrate 10 is arranged so as to be inclined at a certain angle relative to the longitudinal direction of the liquid ejection head 3. Further, in a portion where the recording element substrates 10 are adjacent to each other (adjoining part), at least one ejection orifice 13 of one ejection orifice array overlaps at least one ejection orifice 13 of another ejection orifice array in the recording medium conveyance direction. In FIG. 10, two ejection orifices 13 on the line D are in a relationship to overlap each other. With such arrangement, even if the position of the recording element substrate 10 is slightly shifted from a predetermined position, it is possible to make a black line or a blank area of a recorded image less visible by suitably controlling driving of the overlapping ejection orifices 13. Also, when a plurality of recording element substrates 10 are arranged on a straight line (inline) instead of staggered arrangement, it is possible to suppress a black line or a blank area in the adjoining part between the recording element substrates 10 by using the configuration illustrated in FIG. 10 while suppressing an increase in the length in the recording medium conveyance direction of the liquid ejection head 3. Note that, although the recording element substrate 10 having a parallelogram planar shape is used in the present embodiment, the configuration of the present invention can be preferably employed also when the recording element substrate 10 having, for example, rectangular, trapezoidal, or other planar shapes is used without being limited to the above.

Feature of the Present Invention

Figure 11:
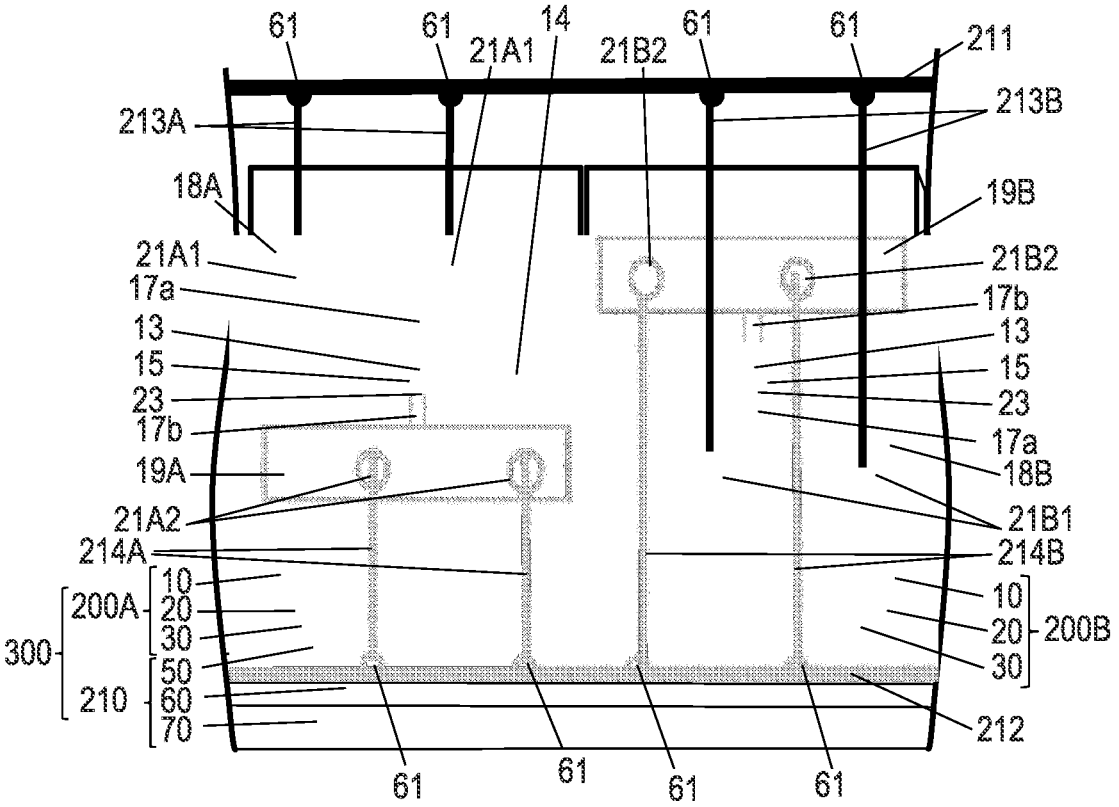
FIG. 11 is a plan view illustrating a liquid flow in adjacent two ejection modules of the liquid ejection head of the first embodiment of the present invention.

The present invention has the following features described below in particular in the liquid ejection apparatus having the configuration described above and thus provides excellent advantageous effects. First, the concept of the present invention will be described with reference to FIG. 11. FIG. 11 is an enlarged plan view provided for describing the concept of the present invention, schematically illustrating a main part of adjacent two ejection modules 200A and 200B and the flow path member 210 to which the adjacent two ejection modules 200A and 200B are joined, and more accurately illustrating the configuration schematically illustrated in FIGS. 8A, 8B, and 8C. As described above, the liquid ejection unit 300 of the present embodiment has the flow path member 210 in which the first flow path member 50, the second flow path member 60, and the third flow path member 70 are stacked and the ejection modules 200 in which the recording element substrates 10, the cover member 20, and the support member 30 are stacked. A plurality of ejection modules 200 are attached to the flow path member 210. Each recording element substrate 10 forming one ejection module 200 has a plurality of ejection orifices 13, a plurality of recording elements 15, and a plurality of pressure chambers 23. The plurality of ejection orifices 13 are aligned in an array to form the ejection orifice array 14. Similarly, the plurality of pressure chambers 23 are aligned in an array to form the pressure chamber array. The ejection orifice array and the pressure chamber array are in parallel and on substantially the same straight line. The supply port 17*a* configured to supply a liquid and the collection port 17*b* configured to collect a liquid that has passed through pressure chambers without being ejected are coupled to each of the plurality of pressure chambers 23. The plurality of supply ports 17*a* provided in one recording element substrate 10 communicate with one liquid supply path 18, and the plurality of collection ports 17*b* communicate with one liquid collection path 19.

In the configuration illustrated in FIG. 11, a liquid is supplied from the individual supply paths 213A and 213B provided to the flow path member 210 to the liquid supply paths 18A and 18B in the adjacent two ejection modules 200A and 200B. Each individual supply path 213A and each individual supply path 213B are both connected to the common supply path 211 and supplied with a liquid from the common supply path 211. Further, the liquid is collected from the liquid collection paths 19A and 19B of the ejection modules 200A and 200B via two individual collection paths 214A and 214B provided in the flow path member 210. Furthermore, the liquid is collected via the common collection path 212 to which each individual collection path 214A and each individual collection path 214B are both connected. The liquid supplied from the common supply path 211 is supplied to the individual supply paths 213A and 213B via the communication ports 61. The liquid then reaches the liquid supply paths 18A and 18B from the individual supply paths 213A and 213B through openings of the first flow path member 50, openings of the support member 30, and openings 21A1 and 21B1 of the cover member 20. The liquid supplied to the liquid supply paths 18A and 18B is then supplied to the pressure chambers 23 via the supply ports 17*a* and ejected from the ejection orifices 13 in accordance with the operation of the recording elements 15. The liquid not ejected and passing through the pressure chambers 23 is collected from the collection ports 17*b* to the liquid collection paths 19A and 19B. The liquid is then collected into the common collection path 212 from the communication ports 61 through openings 21A2 and 21B2 of the cover member 20, openings of the support member 30, and the individual collection paths 214A and 214B via openings of the first flow path member 50. In such a way, the flow of a liquid from the common supply path 211 to the common collection path 212 may be expressed as circulation supply. In the present specification, when the supply side opening and the collection side opening are distinguished, an appendix "1" may be attached to the reference of the supply side opening, and an appendix "2" may be attached to the reference of the collection side opening.

In the present invention, in the adjacent two ejection modules 200A and 200B, openings having substantially the same temperature condition are respectively arranged in portions where the ejection modules 200A and 200B are close to each other so that the temperature difference in the adjoining parts thereof is as small as possible. For example, in the configuration illustrated in FIG. 11, the arrangement of the liquid supply path 18A and the liquid collection path 19A of the ejection module 200A and the arrangement of the liquid supply path 18B and the liquid collection path 19B of the ejection module 200B are opposite to each other. For example, in one of the ejection modules 200A and 200B adjacent to each other, a liquid is supplied from one side (the upper side in FIG. 11) to all the pressure chambers 23. Further, the liquid is collected to the other side (the lower side in FIG. 11) from all the pressure chambers 23. In contrast, in the other of the ejection modules 200A and 200B adjacent to each other, a liquid is supplied from the other side (the lower side in FIG. 11) to all the pressure chambers 23. Further, the liquid is collected to one side (the upper side in FIG. 11) from all the pressure chambers 23.

The ejection modules 200A and 200B have a plurality of openings located on both sides, respectively, interposing the ejection orifice array 14. In one ejection module 200A, the common supply path 211 of the flow path member 210 is connected to the opening 21A1 provided to one side (the upper side in FIG. 11) of the ejection orifice array 14 via the communication ports 61 and the individual supply paths 213A. Furthermore, each opening 21A1 is connected to the pressure chamber 23 and the ejection orifice 13 via the liquid supply path 18A located on one side (the upper side in FIG. 11). Thereby, the liquid supply side flow path from the common supply path 211 configured to supply a liquid to all the ejection modules 200 to the pressure chamber 23 and the ejection orifice 13 is formed. Further, the liquid collection path 19A located on the other side (the lower side in FIG. 11) of the ejection orifice array 14 is connected to the pressure chamber 23 and the ejection orifice 13 and further connected to the individual collection paths 214A via the openings 21A2 provided on the other side (the lower side in FIG. 11). Each individual collection path 214A is connected via the communication port 61 to the common collection path 212 configured to collect the liquid from all the ejection modules 200. Thereby, the liquid collection side flow path from the pressure chamber 23 and the ejection orifice 13 to the common collection path 212 configured to collect the liquid from all the ejection modules 200 is formed. Because of such a configuration, a liquid is supplied to the pressure chamber 23 and the ejection orifice 13 from one side (the upper side in FIG. 11) of the ejection orifice array 14. The liquid that has passed through the pressure chamber 23 and the ejection orifice 13 is then collected to the other side (the lower side in FIG. 11) of the ejection orifice array 14.

In the other ejection module 200B adjacent to the ejection module 200A described above, the common supply path 211 is connected to the opening 21B1 provided to the other side (the lower side in FIG. 11) of the ejection orifice array 14 via the communication ports 61 and the individual supply paths 213B. Furthermore, each opening 21B1 is connected to the pressure chamber 23 and the ejection orifice 13 via the liquid supply path 18B located on the other side (the lower side in FIG. 11). Thereby, the liquid supply side flow path from the common supply path 211 configured to supply a liquid to all the ejection modules 200 to the pressure chamber 23 and the ejection orifice 13 is formed. Further, the liquid collection path 19B located on one side (the upper side in FIG. 11) of the ejection orifice array 14 is connected to the pressure chamber 23 and the ejection orifice 13 and further connected to the individual collection paths 214B via the openings 21B2 provided on one side (the upper side in FIG. 11). Each individual collection path 214B is connected via the communication port 61 to the common collection path 212 configured to collect the liquid from all the ejection modules 200. Thereby, the liquid collection side flow path from the pressure chamber 23 and the ejection orifice 13 to the common collection path 212 configured to collect the liquid from all the ejection modules 200 is formed. Because of such a configuration, a liquid is supplied to the pressure chamber 23 and the ejection orifice 13 from the other side (the lower side in FIG. 11) of the ejection orifice array 14. The liquid that has passed through the pressure chamber 23 and the ejection orifice 13 is then collected to one side (the upper side in FIG. 11) of the ejection orifice array 14. As illustrated in FIG. 11, in the ejection module 200B, the individual supply paths 213B extend in the direction substantially orthogonal to the array direction of the ejection orifice array 14 and beyond the position where the pressure chamber 23 and the ejection orifice 13 are formed. Accordingly, the liquid can be supplied to the pressure chamber 23 and the ejection orifice 13 from the other side (the lower side of FIG. 11). Similarly, the individual collection paths 214B extend in the direction substantially orthogonal to the array direction of the ejection orifice array and beyond the position where the pressure chamber 23 and the ejection orifice 13 are formed, and accordingly, the liquid can be collected into one side (the upper side of FIG. 11) from the pressure chamber 23 and the ejection orifice 13.

In one ejection module 200A, the supply side opening 21A1, the collection side opening 21A2, the supply side opening 21A1, and the collection side opening 21A2 are arranged in this order from one end side to the other end side (the left side to the right side in FIG. 11) of the ejection orifice array 14 in the array direction of the ejection orifice array 14. Therefore, the opening which is located at the adjoining part to the other end (the right end in FIG. 11) of the one ejection module 200A, that is, adjacent to the other ejection module 200B is the collection side opening 21A2. In the other ejection module 200B, the collection side opening 21B2, the supply side opening 21B1, the collection side opening 21B2, and the supply side opening 21B1 are arranged in this order from one end side to the other end side (the left side to the right side in FIG. 11) of the ejection orifice array 14 in the array direction of the ejection orifice array 14. Therefore, the opening which is located at the adjoining part to one end (the left end in FIG. 11) of the other ejection module 200B, that is, adjacent to one ejection module 200A is the collection side opening 21B2. In such a way, openings of the same type (the collection side openings 21A2 and 21B2) are located in the adjoining part between the ejection modules 200A and 200B. Therefore, the ejection modules 200A and 200B have a small temperature difference at the adjoining part thereof.

In such a configuration, the openings 21 are provided at the same position in all the ejection modules 200 that are in use. Further, a change is made only in the configuration of the individual supply paths 213 and the individual collection paths 214 of the flow path member 210 to which the ejection module 200 is attached. Specifically, only the shape of the grooves 52, which define the individual supply paths 213 and the individual collection paths 214 of the first flow path member 50 (see FIG. 5B), and the positions of the communication ports 51 need to be changed between the portion corresponding to the ejection module 200A and the portion corresponding to the ejection module 200B. There is no need for changing other members such as the flow path members 60 and 70 and the ejection modules 200. As described above, according to the present embodiment, in a configuration in which a plurality of ejection modules 200 having exactly the same configuration are aligned, it is possible to reduce a temperature gap at an adjoining part between the ejection modules 200 by causing the temperature condition of adjacent openings 21 to be at the same level.

Comparative Example

Figure 12A:
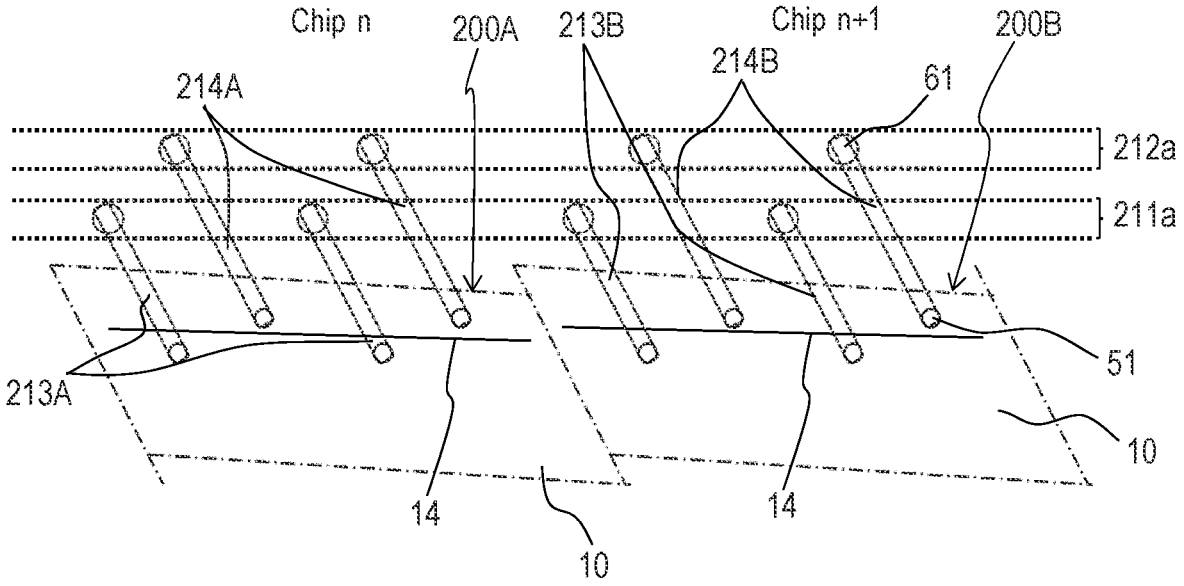
FIG. 12A is an enlarged plan view of a main part illustrating a liquid ejection head of a comparative example.
Figure 12B:
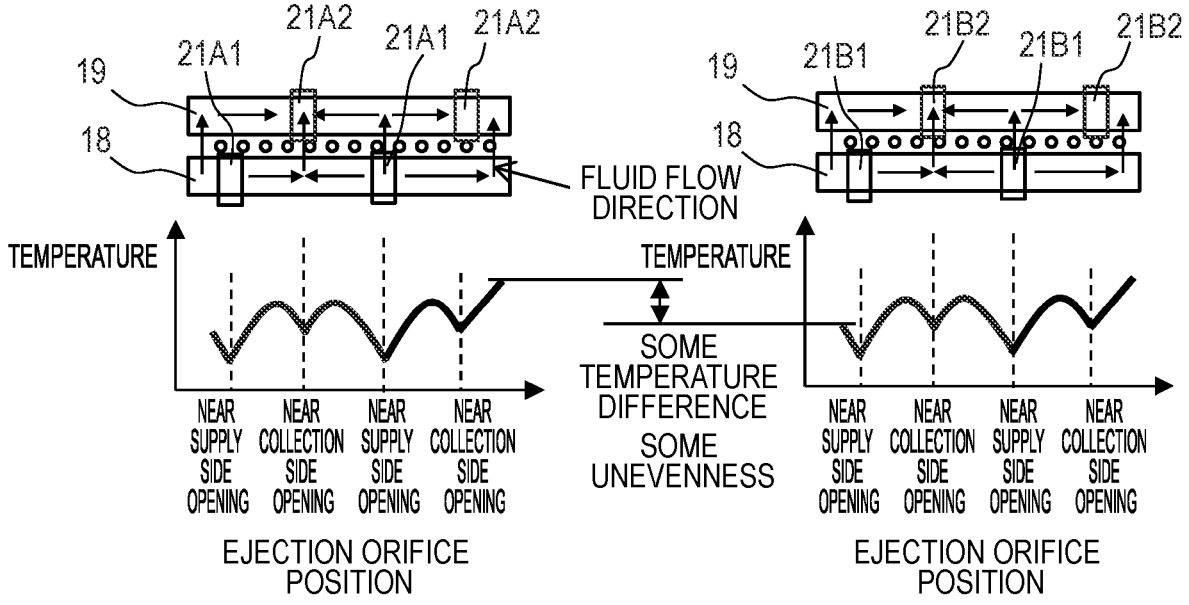
FIG. 12B represents a schematic diagram and a graph illustrating the liquid flow in adjacent two ejection modules and the temperature distribution in the adjacent two ejection modules, respectively.

A liquid ejection head of a comparative example for comparison with the liquid ejection head of the present embodiment will be described. FIG. 12A is a perspective projection of a flow path inside the first flow path member 50 of the flow path member 210 corresponding to the adjacent liquid ejection modules 200A and 200B in the liquid ejection head of the comparative example when viewed from the recording element 15 side. FIG. 12B schematically illustrates positions of the openings 21A1, 21A2, 21B1, and 21B2 corresponding to one ejection orifice array 14 and temperature profiles of the recording element substrate 10 for each of the two ejection modules 200A and 200B illustrated in FIG. 12A. For simplified illustration, the same references as those in the embodiment described above are used in the comparative example. In this comparative example, the individual supply paths 213A and 213B and the individual collection paths 214A and 214B are arranged alternatingly in the ejection orifice array direction, and the supply side openings 21A1 and 21B1 and the collection side openings 21A2 and 21B2 are arranged alternatingly in the ejection orifice array direction. This arrangement is aligned regularly across all the ejection modules 200 without change. Therefore, in all the ejection modules 200, the collection side openings 21 are arranged on one side (for example, the upper side in FIG. 12A) of the ejection orifice array 14, and the supply side openings 21 are arranged on the other side (for example, the lower side in FIG. 12A). Further, since the same number of supply side openings 21 and collection side openings 21 are provided to each ejection orifice 13, the total number of supply side openings 21 and the total number of collection side openings 21 in each ejection module 200 are the same. Therefore, the openings 21 of different types from each other are located in the adjoining part between such ejection modules 200. For example, the collection side opening 21A2 is located in the adjoining part included in the ejection module 200A and adjoining the ejection module 200B, and the supply side opening 21B1 is located in the adjoining part included in the ejection module 200B and adjoining the ejection module 200A.

In such a liquid ejection head, once a liquid flow from the supply side opening 21 through the pressure chamber 23 to the collection side opening 21 occurs, a liquid (ink) at a temperature elevated when the recording element 15 that is a heat generating element generates heat flows to the collection side. Thus, the temperature of the liquid on the collection side rises. Furthermore, when the printing density (ejection duty) increases and the amount of liquid ejected from the ejection orifice 13 becomes larger than the amount of liquid flowing into the pressure chamber 23, the liquid may also flow into the pressure chamber 23 from the collection side opening 21 (a reverse flow in the direction opposite to circulation may occur). In such a case, since a part of the high temperature liquid does not flow out of the collection side opening 21 to the outside of the ejection module 200 and flows to the pressure chamber 23, the temperature of the recording element substrate 10 in contact with the high temperature liquid further increases near the collection side opening 21. Therefore, the temperature difference between a part near the collection side opening 21 and a part near the supply side opening 21 further increases. Thus, as illustrated in a schematic temperature distribution diagram of FIG. 12B, a large temperature difference undesirably occurs between adjacent liquid ejection modules 200. In particular, in the line type liquid ejection head 3 in which a large number of liquid ejection modules 200 are continuously aligned, the temperature difference between adjacent recording element substrates 10 is significant, easily visible image unevenness occurs in an image formed by liquid ejection from the liquid ejection head 3. Note that, since any two ejection modules 200 out of a large number of aligned ejection modules 200 have the relationship described above, "chip n" and "chip n+1" are denoted in FIG. 12A.

Example

Figure 13A:
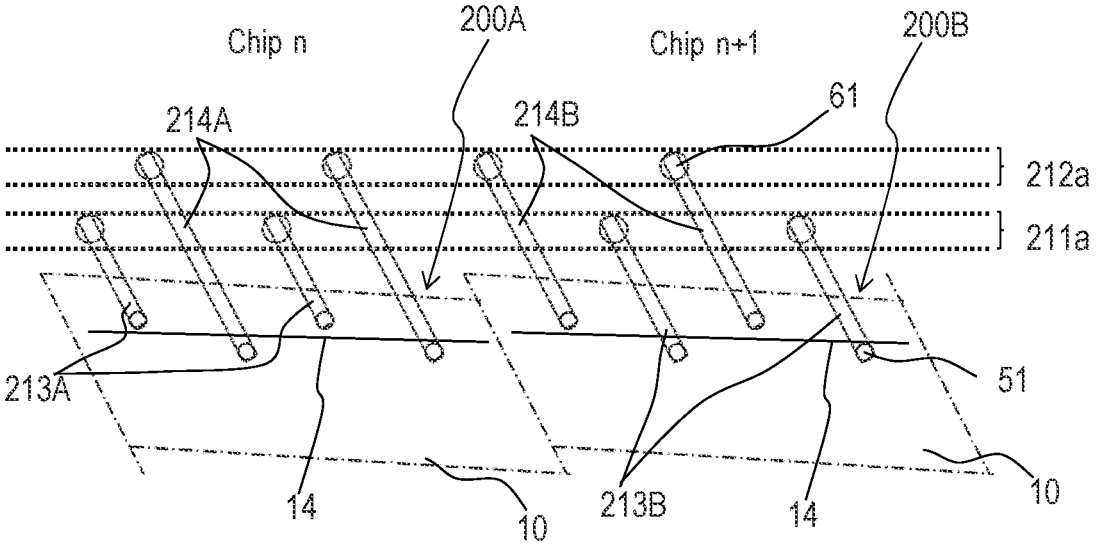
FIG. 13A is an enlarged plan view of a main part illustrating the liquid ejection head of the first embodiment of the present invention.
Figure 13B:
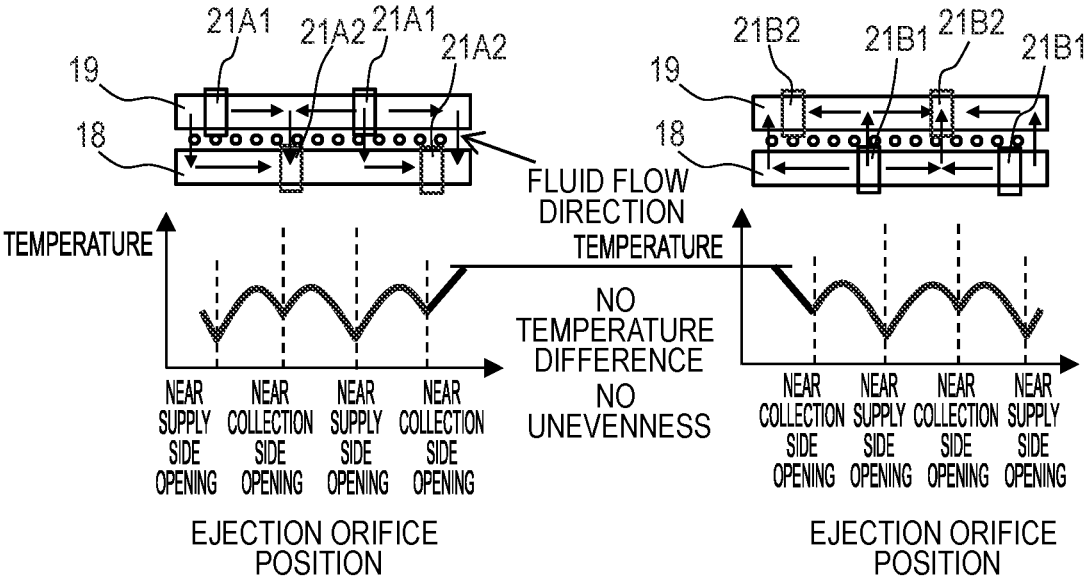
FIG. 13B represents a schematic diagram and a graph illustrating the liquid flow in adjacent two ejection modules and the temperature distribution in the adjacent two ejection modules, respectively.

An example of a liquid ejection head of the present invention provided for solving the problem of the comparative example described above will be described with reference to FIGS. 13A and 13B. FIG. 13A is a perspective projection of a flow path inside the first flow path member 50 of the flow path member 210 corresponding to the adjacent liquid ejection modules 200A and 200B in the liquid ejection head of this example when viewed from the recording element 15 side. FIG. 13B schematically illustrates the positions of the openings 21 corresponding to one ejection orifice array 14 and temperature profiles of the recording element substrate 10 for each of the two ejection modules 200A and 200B illustrated in FIG. 13A. In each ejection module 200 of this example, the individual supply paths 213 and the individual collection paths 214 are arranged alternatingly in the ejection orifice array direction, and the supply side openings 21 and the collection side openings 21 are arranged alternatingly in the ejection orifice array direction in the same manner as the comparative example. In one ejection module 200A, however, the supply side opening 21A1 is arranged at the closest position to one end (the left end in FIG. 13B), and the supply side openings 21A1 and the collection side openings 21A2 are arranged alternatingly toward the other end side (the right side in FIG. 13B). In the other adjacent ejection module 200B, the collection side opening 21B2 is arranged at the closest position to one end (the left end in FIG. 13B), and the collection side openings 21B2 and the supply side openings 21B1 are arranged alternatingly toward the other end side (the right side in FIG. 13B). As a result, in the configuration in which the total number of supply side openings 21 and the total number of collection side openings 21 in each ejection module 200 are the same, openings of the same type are located in the adjoining part between the ejection modules 200. For example, the collection side opening 21A2 is located in the adjoining part included in the ejection module 200A and adjoining the ejection module 200B, and also the collection side opening 21B2 is located in the adjoining part included in the ejection module 200B and adjoining the ejection module 200A. Even when a large temperature difference occurs between a part near the collection side opening and a part near the supply side opening, since the openings of the same type (the collection side openings 21A2 and 21B2 in the example illustrated in FIG. 13B) are located in the adjoining part between the ejection modules 200, not a large temperature difference occurs in the present example. Therefore, even in the line type liquid ejection head 3 in which a plurality of liquid ejection modules 200 are continuously aligned, it is possible to suppress occurrence of image unevenness in an image formed by liquid ejection.

Further, changing the order in alignment of the collection side openings 21 and the supply side openings 21 in the adjacent ejection modules 200 while minimizing a design change can be achieved by changing the length of the individual supply path 213 and the individual collection path 214 of the flow path member 210 connected to each opening 21. Even when the planar positions of the openings 21 of the adjacent ejection modules 200 are the same, one of the openings 21 can be connected to the common supply path 211 in one ejection module 200A, and the opening 21 at the same position can be connected to the common collection path 212 in the other ejection module 200B. To this end, it is only required to change the length of the individual supply path 213 and the individual collection path 214 connecting the common supply path 211 or the common collection path 212 to respective openings 21. Accordingly, it is possible to have an opposite positional relationship of the supply side openings 21 and the collection side openings 21 with respect to the ejection orifice array 14 in the adjacent ejection modules 200. For example, in one ejection module 200A, openings on one side (the upper side in FIG. 13B) of the ejection orifice array 14 are used as the supply side openings 21A1, and openings on the other side (the lower side in FIG. 13B) are used as the collection side openings 21A2. Further, in the other ejection module 200B, openings on one side (the upper side in FIG. 13B) of the ejection orifice array 14 are used as the collection side openings 21B2, and openings on the other side (the lower side in FIG. 13B) are used as the supply side openings 21B1. Accordingly, it is possible to change the arrangement order of the collection side openings 21A2 and 21B2 and the supply side openings 21A1 and 21B1 in the adjacent ejection modules 200A and 200B even with very minor design change from the comparative example described above. Accordingly, a configuration in which openings of the same type are located in the adjoining part between the ejection modules 200A and 200B can be realized. Further, it is possible to suppress a temperature difference in the adjoining part between the ejection modules 200A and 200B to suppress image unevenness in an image formed by liquid ejection.

Note that the above description and each drawing relate to only the portion associated with the flow path in which a single type of liquid (for example, a single color of ink) flows. When the present invention is employed in a liquid ejection head that ejects multiple types of liquids (for example, multicolor ink), the mechanisms including the flow paths described above can be provided for the number of liquid types. According to the present invention, it is possible to provide a liquid ejection head and a liquid ejection apparatus that can suppress variation in the circulation flow rate or the pressure of the liquid among a plurality of pressure chambers and suppress a difference in temperature distribution between adjacent element substrates to suppress image unevenness.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2020-110699, filed Jun. 26, 2020, which is hereby incorporated by reference herein in its entirety.

What is claimed is:

1. A liquid ejection head comprising a plurality of ejection modules each including an element substrate in which a plurality of ejection orifices that eject a liquid are aligned in an array, wherein in one ejection module of the ejection modules adjacent to each other, the liquid is supplied from one side of an ejection orifice array, and the liquid is collected from the other side of the ejection orifice array, wherein in the other ejection module of the ejection modules adjacent to each other, the liquid is supplied from the other side, and the liquid is collected from the one side, wherein the ejection module has a plurality of openings respectively located on both sides of the ejection orifice array, wherein in the one ejection module, the liquid is supplied through the openings located on the one side, and the liquid is collected through the openings located on the other side, wherein in the other ejection module, the liquid is supplied through the openings located on the other side, and the liquid is collected through the openings located on the one side, wherein in each of the ejection modules, the openings on a supply side and the openings on a collection side are arranged alternatingly in an array direction of the ejection orifice array, wherein in the one ejection module of the ejection modules adjacent to each other, the closest opening to one end side in an array direction of the ejection orifice array is an opening on a supply side, and the closest opening to the other end is an opening on a collection side, and wherein in the other ejection module of the ejection modules adjacent to each other, the closest opening to the one end side is an opening on the collection side, and the closest opening to the other end is an opening on the supply side.

2. The liquid ejection head according to claim 1, wherein the element substrate further has a plurality of energy generating elements that generate energy for ejecting a liquid from the ejection orifices and a plurality of pressure chambers comprising the ejection orifices and the energy generating elements, and the plurality of pressure chambers are aligned in an array, and wherein the liquid supplied through the openings is supplied to the pressure chambers, a part of the liquid in the pressure chambers is ejected from the ejection orifices, and another part of the liquid is collected through the openings.

3. The liquid ejection head according to claim 2, wherein each of the ejection modules is provided with:

supply ports connected to the pressure chambers;

a liquid supply path connected to the supply ports and provided with the openings on the supply side;

collection ports connected to the pressure chambers; and a liquid collection path connected to the collection ports and provided with the openings on the collection side; and wherein the supply ports and the liquid supply path are located on the opposite side of the ejection orifice array from the collection ports and the liquid collection path.

4. The liquid ejection head according to claim 3, further comprising a flow path member configured to supply the liquid to the ejection modules and collect the liquid from the ejection modules, wherein the flow path member comprises a common supply path configured to supply a liquid to the plurality of ejection modules, a plurality of individual supply paths connecting the common supply path to the plurality of openings, a common collection path configured to collect a liquid from the plurality of ejection modules, and a plurality of individual collection paths connecting the common collection path to the plurality of openings, wherein in the one ejection module of the ejection modules adjacent to each other, the individual supply paths connect the common supply path to the openings located on one side of the ejection orifice array, and the individual collection paths connect the common collection path to the openings located on the other side of the ejection orifice array, and wherein in the other ejection module of the ejection modules adjacent to each other, the individual supply paths connect the common supply path to the openings located on the other side of the ejection orifice array, and the individual collection paths connect the common collection path to the openings located on the one side of the ejection orifice array.

5. The liquid ejection head according to claim 4, wherein a flow path in which a liquid flows from the common supply path through the individual supply paths, the opening on the supply side, the supply ports, the pressure chambers, the collection ports, the liquid collection path, the openings on the collection side, the individual collection paths, and the common collection path in this order is formed.

6. The liquid ejection head according to claim 5, wherein the openings are provided at the same planar position of all the ejection modules, respectively.

7. A liquid ejection apparatus comprising:

the liquid ejection head according to claim 1; and a conveyance unit that conveys a recording medium.

8. A liquid ejection head comprising a plurality of ejection modules each including an element substrate in which a plurality of ejection orifices that eject a liquid are aligned in an array, wherein the ejection modules have a plurality of openings located on both sides interposing an ejection orifice array, and the plurality of openings include supply side openings to which the liquid is supplied and collection side openings from which the liquid is collected, wherein the openings of the same type are arranged in a part included in one ejection module of the ejection modules adjacent to each other and adjoining the other ejection module and a part included in the other ejection module and adjoining the one ejection module, wherein in the one ejection module, the liquid is supplied through the openings located on one side of the ejection orifice array, and the liquid is collected through the openings located on the other side of the ejection orifice array, wherein in the other ejection module, the liquid is supplied through the openings located on the other side of the ejection orifice array, and the liquid is collected through the openings located on the one side of the ejection orifice array, wherein in each of the ejection modules, the openings on a supply side and the openings on a collection side are arranged alternatingly in an array direction of the ejection orifice array, wherein in one ejection module of the ejection modules adjacent to each other, the closest opening to one end side in an array direction of the ejection orifice array is one of the supply side openings, and the closest opening to the other end is one of the collection side openings, and wherein in the other ejection module of the ejection modules adjacent to each other, the closest opening to the one end side is one of the collection side openings, and the closest opening to the other end is one of the supply side openings.

9. The liquid ejection head according to claim 8, wherein the element substrate further has a plurality of energy generating elements that generate energy for ejecting a liquid from the ejection orifices and a plurality of pressure chambers comprising the ejection orifices and the energy generating elements, and the plurality of pressure chambers are aligned in an array, and wherein the liquid supplied through the openings is supplied to the pressure chambers, a part of the liquid in the pressure chambers is ejected from the ejection orifices, and another part of the liquid is collected through the openings.

10. The liquid ejection head according to claim 9, wherein each of the ejection modules is provided with:

supply ports connected to the pressure chambers;

a liquid supply path connected to the supply ports and provided with the openings on the supply side;

collection ports connected to the pressure chambers; and a liquid collection path connected to the collection ports and provided with the openings on the collection side; and wherein the supply ports and the liquid supply path are located on the opposite side of the ejection orifice array from the collection ports and the liquid collection path.

11. The liquid ejection head according to claim 10, further comprising a flow path member configured to supply the liquid to the ejection modules and collect the liquid from the ejection modules, wherein the flow path member comprises a common supply path configured to supply a liquid to the plurality of ejection modules, a plurality of individual supply paths connecting the common supply path to the plurality of openings, a common collection path configured to collect a liquid from the plurality of ejection modules, and a plurality of individual collection paths connecting the common collection path to the plurality of openings, wherein in the one ejection module of the ejection modules adjacent to each other, the individual supply paths connect the common supply path to the openings located on one side of the ejection orifice array, and the individual collection paths connect the common collection path to the openings located on the other side of the ejection orifice array, and wherein in the other ejection module of the ejection modules adjacent to each other, the individual supply paths connect the common supply path to the openings located on the other side of the ejection orifice array, and the individual collection paths connect the common collection path to the openings located on the one side of the ejection orifice array.

12. The liquid ejection head according to claim 11, wherein a flow path in which a liquid flows from the common supply path through the individual supply paths, the opening on the supply side, the supply ports, the pressure chambers, the collection ports, the liquid collection path, the openings on the collection side, the individual collection paths, and the common collection path in this order is formed.

13. The liquid ejection head according to claim 12, wherein the openings are provided at the same planar position of all the ejection modules, respectively.

14. A liquid ejection head comprising a liquid ejection unit, wherein the liquid ejection unit comprises a plurality of ejection modules and a flow path member, the plurality of ejection modules each comprising:

a recording element substrate comprising, in an array, a plurality of ejection orifices that eject a liquid, a plurality of recording elements driven to eject the liquid from the ejection orifices, a plurality of pressure chambers comprising the ejection orifices and the recording elements, a plurality of supply ports configured to supply the liquid to the pressure chambers, a plurality of collection ports that transfer the liquid from the pressure chambers via the pressure chambers, and further comprising a liquid supply path that communicates with the plurality of supply ports and supplies the liquid to the supply ports, a liquid collection path that is arranged on the opposite side of the pressure chambers from the liquid supply path, communicates with the plurality of collection ports, and collects the liquid from the collection ports, and a support member that supports the recording element substrate and comprises at least two supply side openings configured to supply the liquid to the liquid supply path and at least two collection side openings configured to collect the liquid from the liquid collection path, the plurality of ejection modules being arranged such that the ejection orifices are aligned in an array, the flow path member comprising individual supply flow paths connected to the supply side openings of the ejection modules and configured to supply the liquid, individual collection flow paths connected to the collection side openings and configured to collect the liquid, a common supply flow path connected to each of the individual supply flow paths provided in the plurality of ejection modules, and a common collection flow path connected to each of the individual collection flow paths provided in the plurality of ejection modules, wherein the liquid supply path and the liquid collection path of a first ejection module of the plurality of ejection modules are arranged such that the liquid supply path is arranged on one side of the pressure chambers and the liquid collection path is arranged on the other side, and the supply side openings communicating with the liquid supply path and the collection side openings communicating with the liquid collection path are aligned alternatingly in order of a supply side opening, a collection side opening, a supply side opening, and a collection side opening from one side to the other with respect to an alignment direction of the ejection orifices, wherein the liquid supply path and the liquid collection path of a second ejection module arranged adjacent to the first ejection module are arranged such that the liquid collection path is arranged on one side of the pressure chambers that is opposite to the first ejection module and the liquid supply path is arranged on the other side, and the supply side openings communicating with the liquid supply path and the collection side openings communicating with the liquid collection path are aligned alternatingly in order of a collection side opening, a supply side opening, a collection side opening, and a supply side opening from one side to the other with respect to an alignment direction of the ejection orifices, wherein the same common supply flow path is connected to the supply side openings respectively provided in the first and second modules via the individual supply flow paths, and the same common collection flow path is connected to the collection side openings respectively provided in the first and second modules via the individual collection flow paths, wherein positions of opening portions provided in the recording element substrates forming the ejection modules are the same in the first and second ejection modules, and wherein the liquid ejection unit causes a liquid flow in order of the common supply path, the individual supply flow paths, the supply side openings, the liquid supply path, the supply ports, the pressure chambers, the collection ports, the liquid collection path, the collection side openings, the individual collection flow paths, and the common collection flow path.

* * * * *